US011443673B2

(12) United States Patent
Takahashi

(10) Patent No.: US 11,443,673 B2
(45) Date of Patent: Sep. 13, 2022

(54) ELECTRO-OPTICAL DEVICE AND ELECTRONIC APPARATUS

(71) Applicant: SEIKO EPSON CORPORATION, Tokyo (JP)

(72) Inventor: Nariya Takahashi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/362,493

(22) Filed: Jun. 29, 2021

(65) Prior Publication Data

US 2021/0407362 A1 Dec. 30, 2021

(30) Foreign Application Priority Data

Jun. 30, 2020 (JP) ..... JP2020-112525

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01)

(58) Field of Classification Search
CPC ..... G09G 3/20; G09G 2310/0275; G09G 2310/08
See application file for complete search history.

(56) References Cited

U.S. PATENT DOCUMENTS

2005/0134538 A1 6/2005 Aoki
2009/0179835 A1 7/2009 Ito
2019/0108778 A1* 4/2019 Lee ..... G09G 3/006
2019/0108811 A1* 4/2019 Kim ..... G09G 3/3688
2020/0321357 A1* 10/2020 Kimura ..... H01L 27/127
2020/0326570 A1* 10/2020 Kawashima ..... G02F 1/136213
2020/0326601 A1* 10/2020 Kimura ..... G02F 1/1337

FOREIGN PATENT DOCUMENTS

JP H11-119736 A 4/1999
JP 2005-157304 A 6/2005
JP 2009-168849 A 7/2009

* cited by examiner

*Primary Examiner* — Sejoon Ahn
(74) *Attorney, Agent, or Firm* — Oliff PLC

(57) ABSTRACT

An electro-optical device includes an electro-optical panel including first to n-th (n is an integer of 2 or greater) data line blocks with each data line block including a first data line group and a second data line group, a first circuit device, and a second circuit device. The first circuit device drives, in an i-th phase of phase development drive, the first data line group of an i-th data line block of the first to n-th data line blocks, and the second circuit device drives, in the i-th phase of the phase development drive, the second data line group of the i-th data line block of the first to n-th data line blocks.

10 Claims, 16 Drawing Sheets

ELECTRO-OPTICAL DEVICE AND ELECTRONIC APPARATUS

The present application is based on, and claims priority from JP Application Serial Number 2020-112525, filed Jun. 30, 2020, the disclosure of which is hereby incorporated by reference herein in its entirety.

BACKGROUND

1. Technical Field

The present disclosure relates to an electro-optical device and an electronic apparatus.

2. Related Art

In recent years, phase development drive is widely known as a driving method for an electro-optical panel. A circuit device, which performs phase development control, samples an image signal that has data corresponding to each pixel position in a time sequence, and then outputs, in parallel, a plurality of phase development signals that are converted to data lengths longer than a sampling period thereof.

For example, JP-A-2005-157304 discloses a configuration in which a phase development circuit device is arranged at a given substrate and is coupled to an electro-optical panel using a flexible substrate different from the foregoing substrate.

When increasing the resolution of the electro-optical panel, it is necessary to improve the driving capability of the phase development circuit device or to increase the number of outputs of the circuit device. However, in consideration of problems such as heat generation, it is not easy to improve the capability of the circuit device or increase the number of outputs.

SUMMARY

One aspect of the present disclosure relates to an electro-optical device including an electro-optical panel including first to n-th data line blocks, each of the data line blocks including a first data line group and a second data line group, n being an integer of 2 or greater, a first circuit device configured to drive the electro-optical panel, and a second circuit device configured to drive the electro-optical panel, wherein the first to n-th data line blocks are, along a scanning line direction of the electro-optical panel, arranged side-by-side so that an i+1-th data line block is located next to an i-th data line block, i being an integer satisfying $1 \leq i < n$, the first circuit device is configured to, in an i-th phase of phase development drive, drive the first data line group of the i-th data line block of the first to n-th data line blocks, and the second circuit device is configured to, in the i-th phase of the phase development drive, drive the second data line group of the i-th data line block of the first to n-th data line blocks.

Another aspect of the present disclosure relates to an electronic apparatus including the electro-optical device described above.

DESCRIPTION OF EXEMPLARY EMBODIMENTS

Exemplary embodiments of the present disclosure will be described in detail hereinafter. Note that the exemplary embodiments described hereinafter are not intended to unjustly limit the content of the present disclosure as set forth in the claims, and all of the configurations described in the embodiments are not always required to solve the issues described in the exemplary embodiments.

1. First Exemplary Embodiment

1.1 Outline

Recently, a phase development circuit device has been used to drive and display a 2K1K panel. The 2K1K panel is a panel having a pixel count of 1920×1080, for example. In recent years, the resolution of the display has been increased, and a 4K2K panel has been used. The 4K2K panel is a panel having a pixel count of 3840×2160, for example. When a phase development circuit device is used for the drive display of a high resolution panel such as a 4K2K panel, the driving capability is insufficient with the current circuit device. In order to support the high resolution panel, it is necessary to improve the driving capability of the phase development circuit device or to increase the number of outputs, but is difficult from the perspective of heat generation, etc. To deal with this, an approach for driving a high resolution panel by using a plurality of phase development circuit devices is conceivable.

Figure 1:
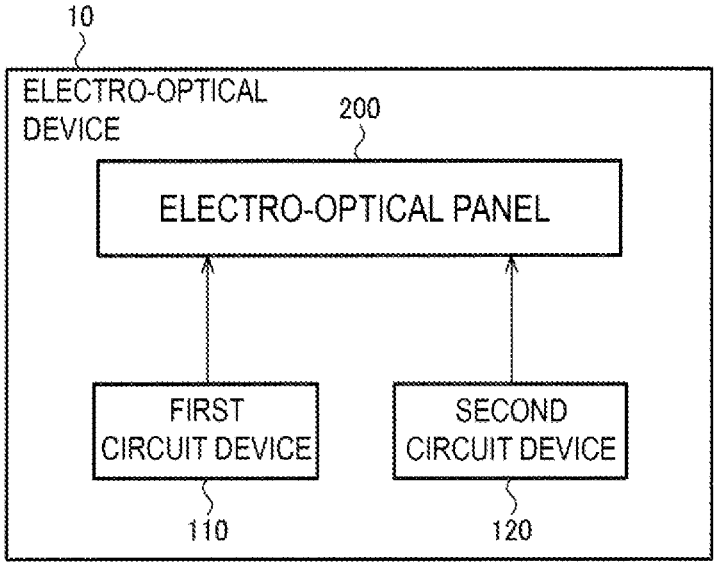
FIG. 1 is a configuration example of an electro-optical device.

FIG. 1 is a diagram illustrating a configuration of an electro-optical device 10 according to the present exemplary embodiment. The electro-optical device 10 includes an electro-optical panel 200, a first circuit device 110, and a second circuit device 120. The electro-optical panel 200 includes a plurality of pixels arranged in a matrix. The first circuit device 110 is a phase development circuit that drives the electro-optical panel 200. The second circuit device 120 is a phase development circuit that drives the electro-optical panel 200. Each of the first circuit device 110 and the second circuit device 120 is an integrated circuit device realized by a semiconductor chip. In addition, although FIG. 1 is an example in which the number of circuit devices provided at the electro-optical device 10 is two, the present exemplary embodiment is not limited thereto, and the number of circuit devices may be three or more.

Providing a plurality of phase development circuit devices allows for dispersing heat generating sources. Therefore, even when the electro-optical panel 200 has a high resolution, it is possible to appropriately drive the electro-optical panel 200 while suppressing heat generation. For example, the first circuit device 110 is a chip at which each circuit described below is formed using FIG. 2, and is encapsulated in a first package. The second circuit device 120 is a chip at which each circuit described below is formed using FIG. 3, and is encapsulated in a second package different from the first package. In this manner, by encapsulating the first circuit device 110 and the second circuit device 120 in separate packages, heat dissipation can be facilitated, and thus it is possible to further suppress the effect of the heat generation from by each circuit device. Note that the first circuit device 110 and the second circuit device 120 may be bare chips.

Here, an image signal that is output of the first circuit device 110 and an image signal that is output of the second circuit device 120 have variations per circuit device, so that output voltages thereof are slightly different. Therefore, when a plurality of circuit devices are simply used, a gradation difference caused by a difference in the output voltages may be visually recognized, and the display quality may deteriorate. Thus, in the present exemplary embodiment, an arrangement of a data line group driven by the first circuit device 110 and a data line group driven by the second circuit device 120 is considered. The detailed exemplary embodiment will be described below.

1.2 First Circuit Device and Second Circuit Device

Figure 2:
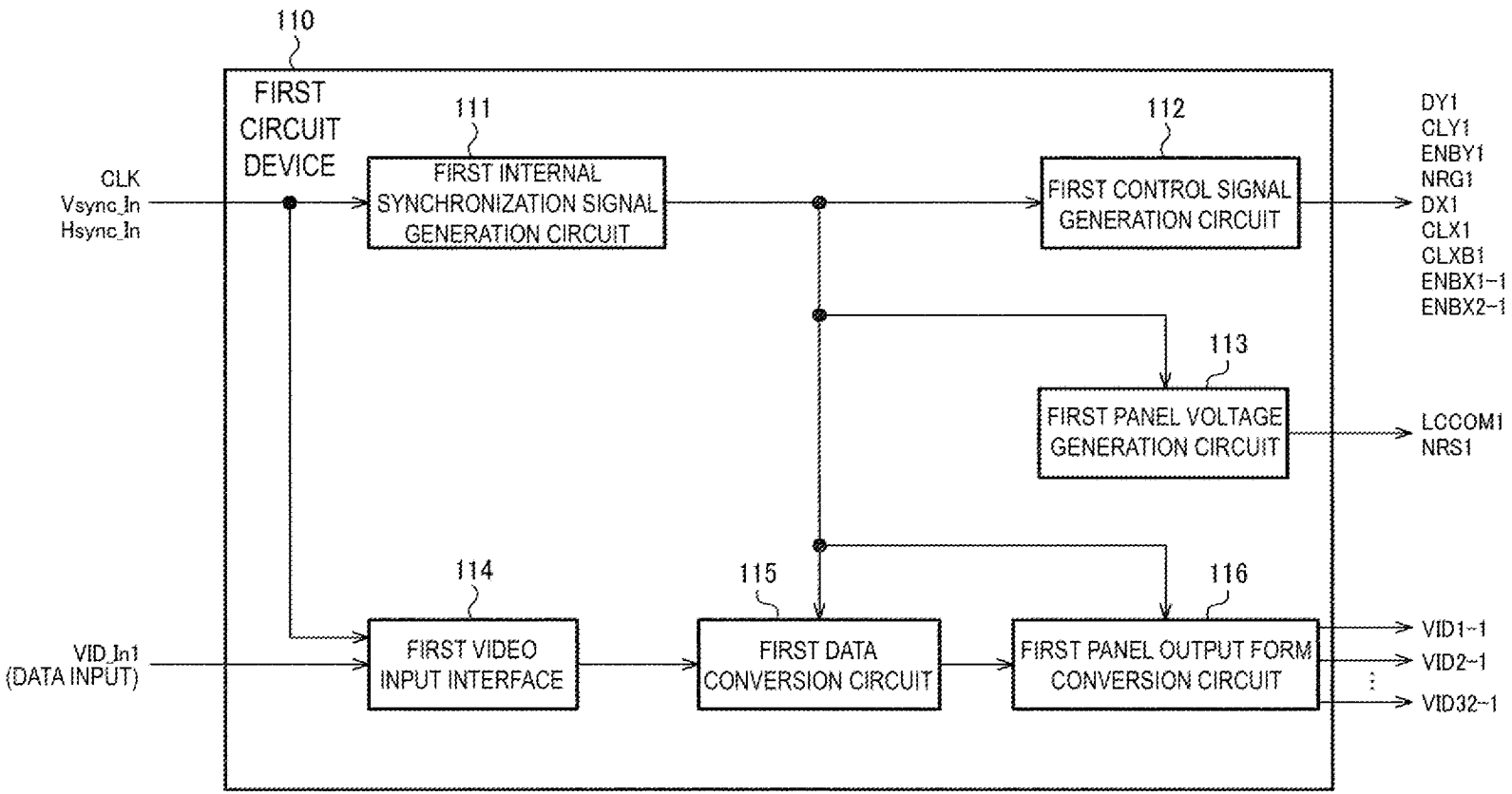
FIG. 2 is a configuration example of an first circuit device.

FIG. 2 is a diagram illustrating a configuration of the first circuit device 110. The first circuit device 110 includes a first internal synchronization signal generation circuit 111, a first control signal generation circuit 112, a first panel voltage generation circuit 113, a first video input interface 114, a first data conversion circuit 115, and a first panel output form conversion circuit 116. However, the configuration of the first circuit device 110 is not limited to FIG. 2, and some configurations may be omitted, or other configurations may be added.

The first internal synchronization signal generation circuit 111 generates an internal synchronization signal used for synchronization in the first circuit device 110 based on an external clock signal CLK, a vertical synchronization input signal Vsync_In, and a horizontal synchronization input signal Hsync_In. The internal synchronization signal is supplied to the first control signal generation circuit 112, the first panel voltage generation circuit 113, the first data conversion circuit 115, and the first panel output form conversion circuit 116.

The first control signal generation circuit 112 is capable of outputting a control signal used to control the electro-optical panel 200. The control signal output by the first circuit device 110 includes DY1, CLY1, ENBY1, NRG1, DX1, CLX1, CLXB1, ENBX1-1, ENBX2-1. Each of the control signals is described below.

The first panel voltage generation circuit 113 is capable of outputting a voltage signal to be used in the electro-optical panel 200. The first panel voltage generation circuit 113 outputs LCCOM1 and NRS1. LCCOM1 is a common voltage. NRS1 is a voltage used for pre-charging.

The first video input interface 114 is an interface for acquiring a digital image signal. The first video input interface 114 acquires, for example, VID_In1, which is data in which digital image data corresponding to odd-numbered data lines 230 of the electro-optical panel 200 is arranged in a time series manner.

The first data conversion circuit 115 performs correction processing such as gamma correction on the image signal acquired by the first video input interface 114.

The first panel output form conversion circuit 116 processes the corrected digital image signal into a signal suitable for supply to the electro-optical panel 200. For example, the first panel output form conversion circuit 116 has a Digital to Analog (D/A) conversion circuit, a Serial to Parallel (S/P) conversion circuit, and an amplification circuit.

The D/A converter circuit converts the digital image signal into an analog image signal. The S/P converter circuit deploys the image signal after the D/A conversion into a plurality of systems, and performs a serial to parallel conversion in which a signal of each system extend in a time-axis direction. An example in which a plurality of systems are 32 systems will be described below, while the specific number of systems can be modified in various variations. The amplification circuit performs amplification processing on signals of the 32 systems after the serial to parallel conversion, and outputs the processed signals as image signals after phase development. The image signals include, for example, VID1-1, VID2-1, . . . , VID32-1.

Note that in the above, an example is illustrated in which the D/A conversion is performed in a first stage of the first panel output form conversion circuit 116, while the order of processing is not limited thereto. For example, the D/A conversion may be performed after the serial to parallel conversion and the amplification processing, or may be performed during these processes. The D/A conversion may be performed prior to the correction processing such as gamma correction.

Figure 3:
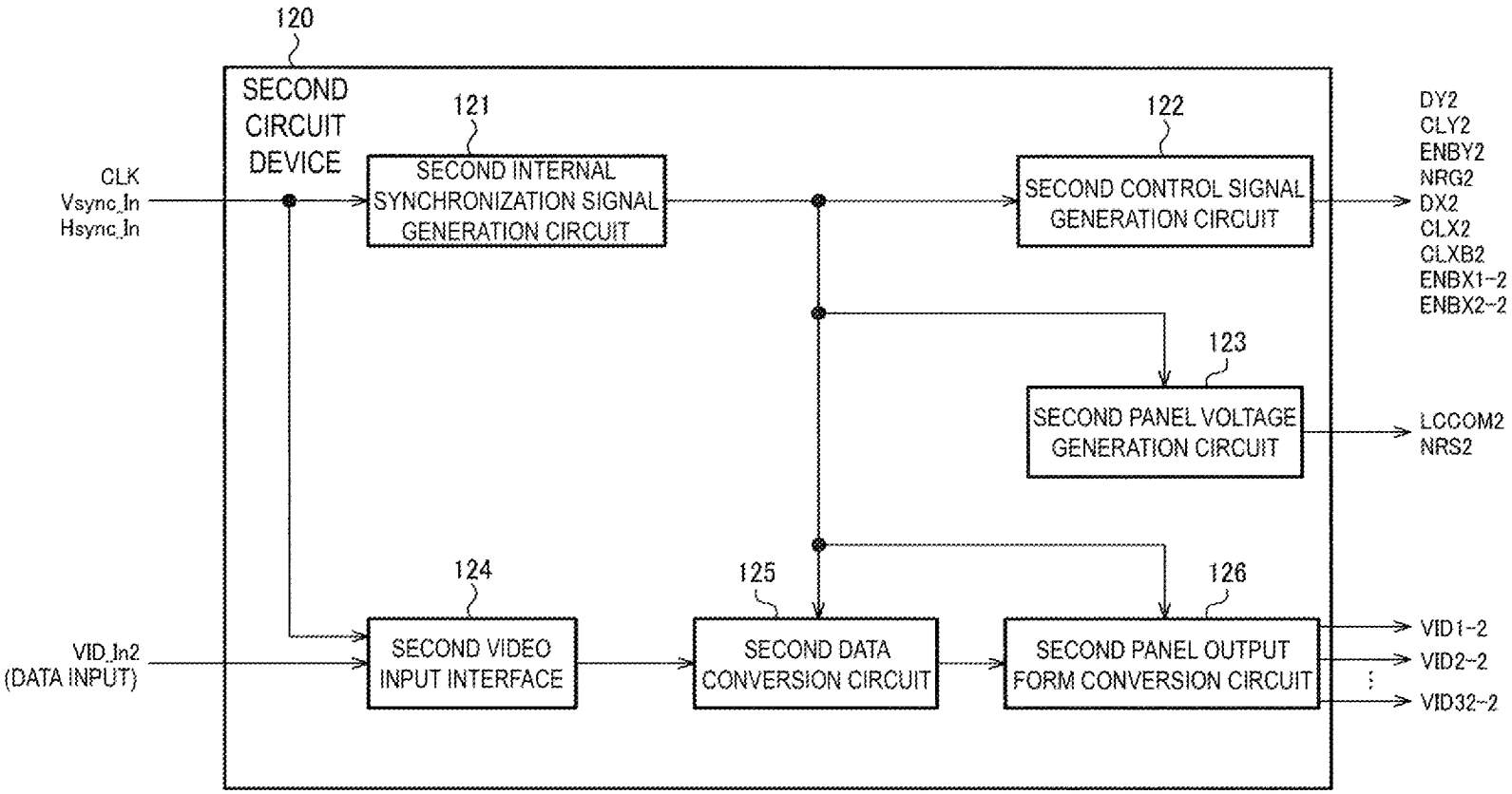
FIG. 3 is a configuration example of a second circuit device.

FIG. 3 is a diagram illustrating a configuration of the second circuit device 120. The second circuit device 120 includes a second internal synchronization signal generation circuit 121, a second control signal generation circuit 122, a second panel voltage generation circuit 123, a second video input interface 124, a second data conversion circuit 125, and a second panel output form conversion circuit 126. In other words, a circuit device with the same configuration as the first circuit device 110 can be used for the second circuit device 120. The same portions as the first circuit device 110 will be omitted from the detailed description.

The second control signal generation circuit 122 is capable of outputting DY2, CLY2, ENBY2, NRG2, DX2, CLX2, CLXB2, ENBX1-2, ENBX2-2 as control signals.

The second panel voltage generation circuit 123 is capable of outputting a common voltage LCCOM2 and a pre-charge voltage NRS2.

The second video input interface 124 acquires, for example, VID_In2, which is data in which digital image data corresponding to even-numbered data lines 230 of the electro-optical panel 200 is arranged in a time series manner.

The second panel output form conversion circuit 126 outputs VID1-2, VID2-2, . . . , VID32-2, which are image signals after phase development.

Figure 4:
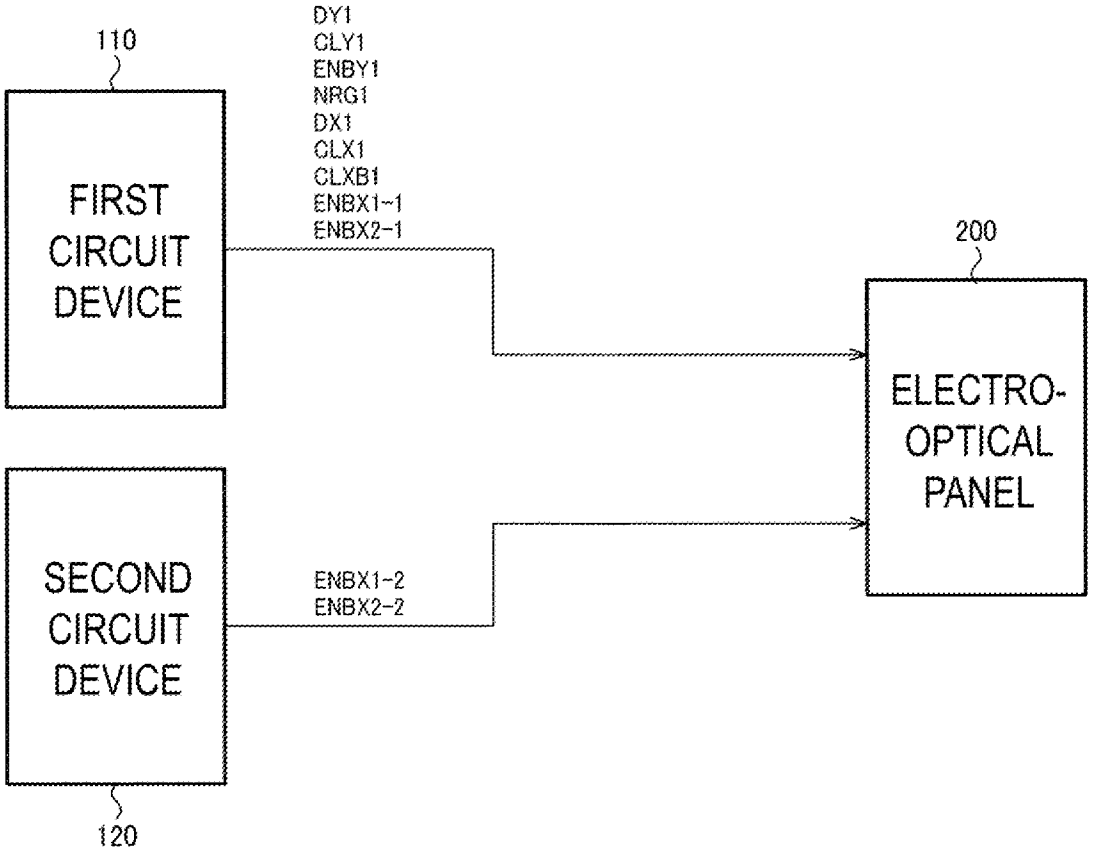
FIG. 4 is an example of control signals output by the first circuit device and the second circuit device.

FIG. 4 is a diagram illustrating an example of control signals output by the first circuit device 110 and the second circuit device 120. For example, the first circuit device 110 outputs the control signals DY1, CLY1, ENBY1, NRG1, DX1, CLX1, CLXB1, ENBX1-1, and ENBX2-1 to the electro-optical panel 200. The second circuit device 120 outputs ENBX1-2 and ENBX2-2 to the electro-optical panel 200, and does not output DY2, CLY2, ENBY2, NRG2, DX2, CLX2, CLXB2 to the electro-optical panel 200.

In the example illustrated in FIG. 4, DY1, CLY1, ENBY1, NRG1, DX1, CLX1, CLXB1 generated by the first circuit device 110 are used as the control signals DY, CLY, ENBY, NRG, DX, CLX, CLXB of the electro-optical panel 200. Further, for the enable signal, ENBX1-1 and ENBX2-1 of the first circuit device 110 and ENBX1-2 and ENBX2-2 of the second circuit device 120 are respectively used.

Figure 5:
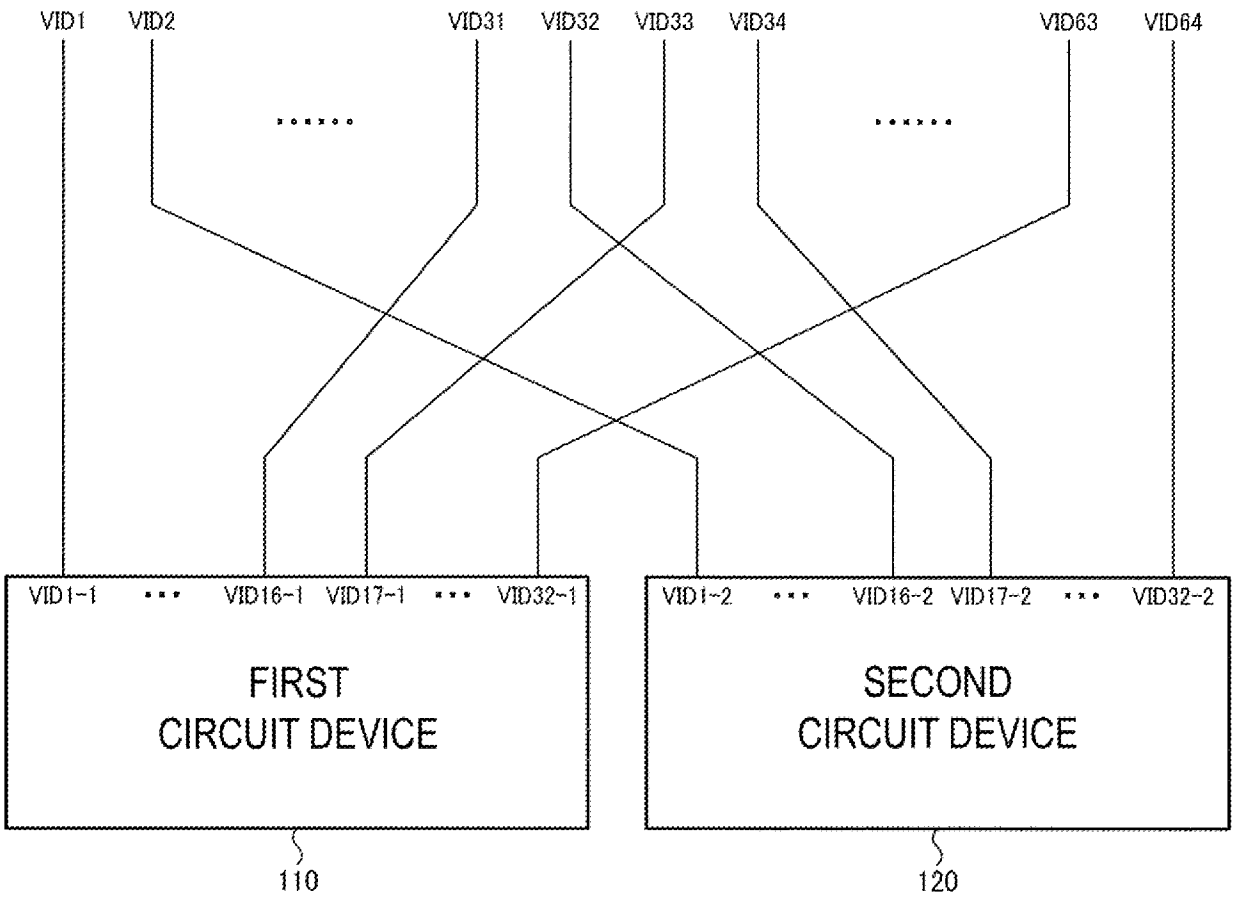
FIG. 5 is a diagram illustrating a correspondence relationship between phase-developed image signals.

FIG. 5 is a diagram illustrating a relationship between the image signals output by the first circuit device 110 and the second circuit device 120 and the image signals input to the electro-optical panel 200. Note that FIG. 5 is a schematic diagram illustrating the relationship between the image signals, and a configuration in which such wiring is physically provided is not required. As described below using FIG. 6, the electro-optical panel 200 of the present exemplary embodiment is a panel in which pixels are driven in block units, for example, with 64 data lines 230 as one block. In other words, VID1 to VID64, which are image signals of the phase development of the 64 systems, are input into the electro-optical panel 200. As described above using FIG. 2 and FIG. 3, the first circuit device 110 outputs VID1-1 to VID32-1 which are image signals of the phase development of the 32 systems, and the second circuit device 120 outputs VID1-2 to VID32-2 which are image signals of the phase development of the 32 systems.

As illustrated in FIG. 5, in an approach of the present exemplary embodiment, VID1-1, VID2-1, . . . , VID32-1 of the first circuit device 110 correspond to VID1, VID3, . . . , VID63, respectively. In other words, a first group of data signals output by the first circuit device 110 corresponds to the odd-numbered image signals of the image signals of the 64 systems. Further, VID1-2, VID2-2, . . . , VID32-2 of the second circuit device 120 correspond to VID2, VID4, . . . , VID64, respectively.

In other words, a second group of data signals output by the second circuit device 120 corresponds to the even-numbered image signals of the image signals of the 64 systems.

1.3 Driving Approach of Electro-optical Panel

Figure 6:
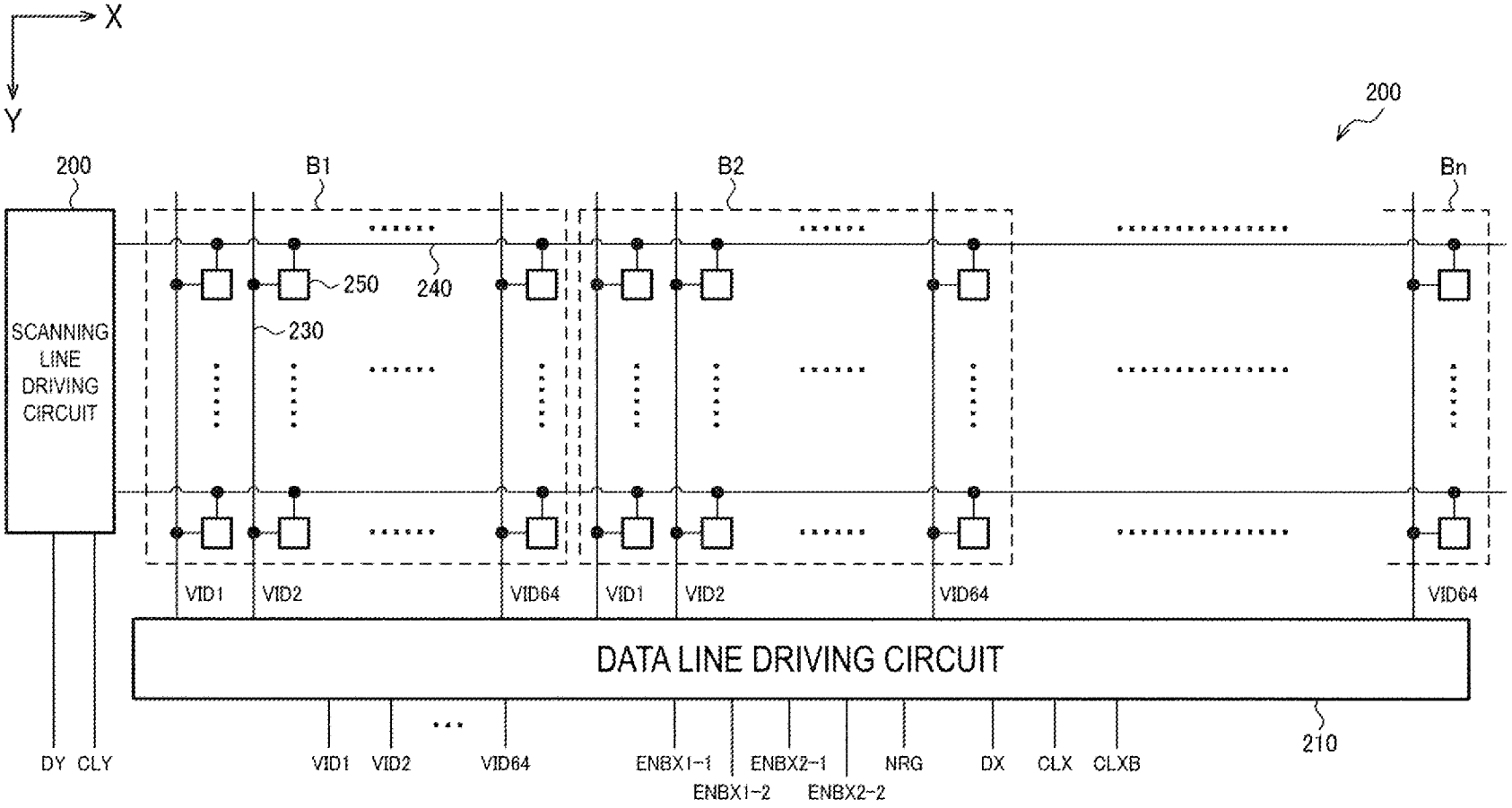
FIG. 6 is an configuration example of an electro-optical panel.

FIG. 6 is a diagram illustrating a configuration of the electro-optical panel 200. The electro-optical panel 200 includes a data line driving circuit 210 and a scanning line driving circuit 220. The electro-optical panel 200 includes a plurality of scanning lines 240 extending in the X direction and coupled to the scanning line driving circuit 220, and a plurality of the data lines 230 extending in the Y direction and coupled to the data line driving circuit 210. Pixels 250 are provided at positions where the scanning lines 240 and the data lines 230 intersect. For example, each of the pixels 250 is constituted by a pixel electrode, a counter electrode, and a liquid crystal sandwiched by the two electrodes. Pixel electrodes are coupled to the scanning lines 240 and the data lines 230 via Thin Film Transistors (TFT) (not illustrated). Specifically, gates of the TFTs are coupled to the scanning lines 240, sources are coupled to the data lines 230, and drains are coupled to the pixel electrodes.

In the present exemplary embodiment, the number of scanning lines 240 is p, and the number of data lines 230 is q. p and q are each an integer of 2 or greater. The plurality of pixels 250 are arranged in a matrix of p rows and q columns in the X direction and the Y direction. Additionally, the data lines 230, which has a total of q lines, are divided into first to n-th data line blocks B1 to Bn, with 64 lines as a unit, corresponding to a phase development number. n is an integer equal to or greater than 2. The 64 data lines 230 belonging to one data line block are each supplied with VID1 to VID64, which correspond to the 64 image signals that have undergone the phase development. In other words, in the electro-optical panel 200 of the present exemplary embodiment, for example, the pixels are driven in block units with the 64 data lines 230 as one block, while the data line blocks of B1 to Bn are collections of data lines corresponding to the driven block units. Note that as described below using FIG. 12, a phase difference may occur between the image signal output from the first circuit device 110 and the image signal output from the second circuit device 120, therefore, the supply timings of all of VID1 to VID64 are not exactly matched.

The scanning line driving circuit 220 and the data line driving circuit 210 are circuits for driving each pixel 250. The scanning line driving circuit 220 is a circuit that sequentially selects each of the plurality of scanning lines 240. The scanning line driving circuit 220 in the present exemplary embodiment has, for example, a shift register of p bits, and outputs, for each vertical scanning period for each of the p scanning lines 240, scanning signals that are sequentially at an active level for each horizontal scanning period. For example, the scanning line driving circuit 220 outputs the scanning signals by sequentially shifting a transfer start pulse DY supplied at the beginning of the vertical scanning period in accordance with a clock signal CLY. CLY is a clock signal having a period corresponding to a single horizontal scanning period.

The data line driving circuit 210 is a circuit that samples VID1 to VID64 supplied to image signal lines 215 and supplies the sampled signal to each data line 230.

Note that the electro-optical panel 200 according to the present exemplary embodiment may have two operation modes in which the sampling direction of the image signals with respect to the plurality of data lines 230 is different. In a first operation mode of the foregoing two operation modes, during each horizontal scanning period, the image signals are sampled in a sequence from a data line 230 located on the negative side in the X direction to a data line 230 located on the positive side. In a second operation mode, during each horizontal scanning period, the image signals are sampled in a sequence from a data line 230 located on the positive side in the X direction to a data line 230 located on the negative side. For example, the data line driving circuit 210 includes a shift register 211 in which a shift direction of a transfer initiation pulse DX is switched in accordance with the operating mode.

Figure 7:
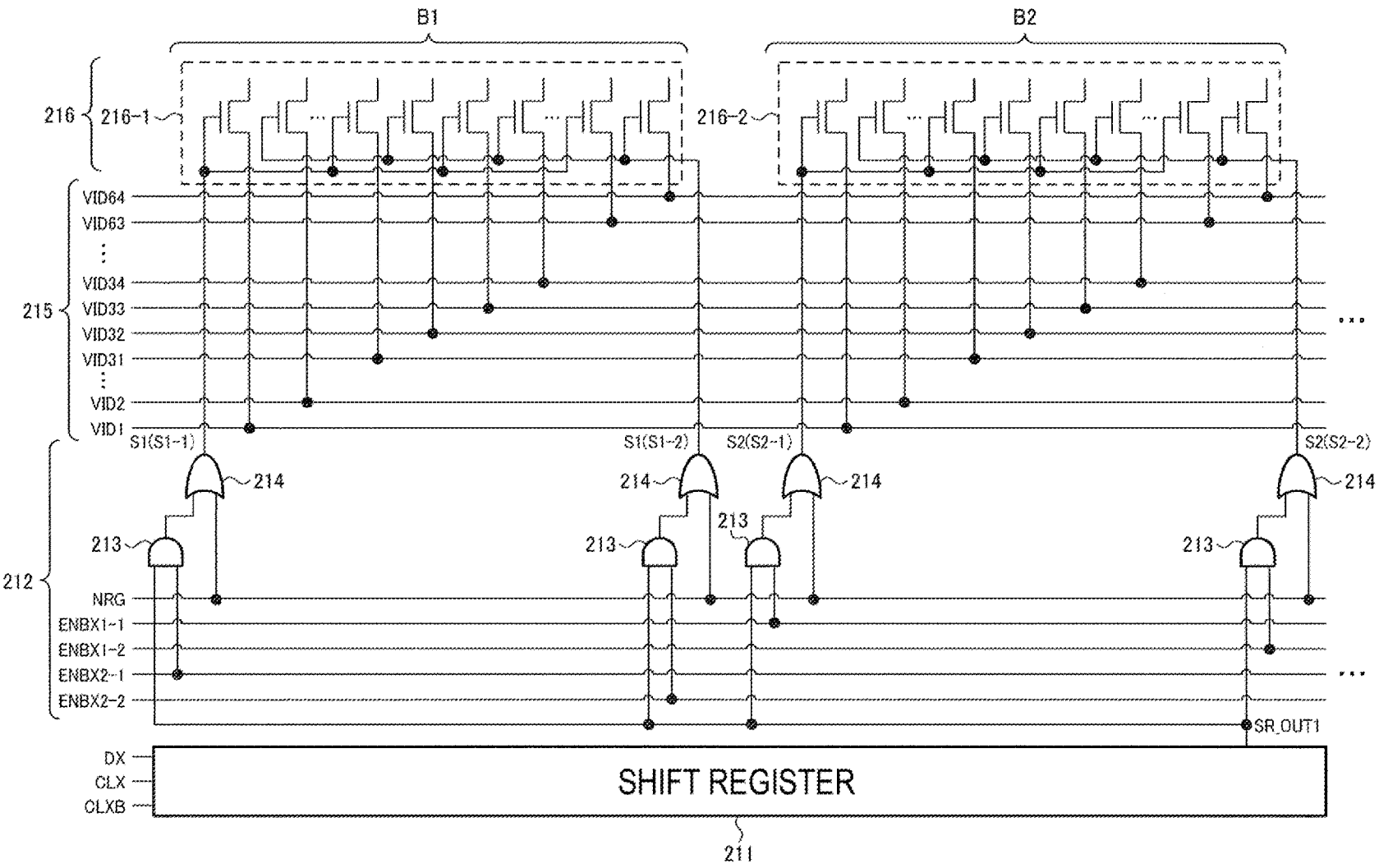
FIG. 7 is a configuration example of a data line driving circuit.

FIG. 7 is a diagram illustrating a configuration of the data line driving circuit 210. The data line driving circuit 210 has the shift register 211, an enabling circuit 212, image signal lines 215, and a switch circuit 216. The switch circuit 216 includes first to n-th switch circuits 216-1 to **216-*n*. Hereinafter, i is an integer from 1 to n. Note that FIG. 7 illustrates a portion of the data line driving circuit 210** related to the data line blocks B1 and B2, while the same applies to a configuration in which B3 and subsequent configurations.

Figure 9:
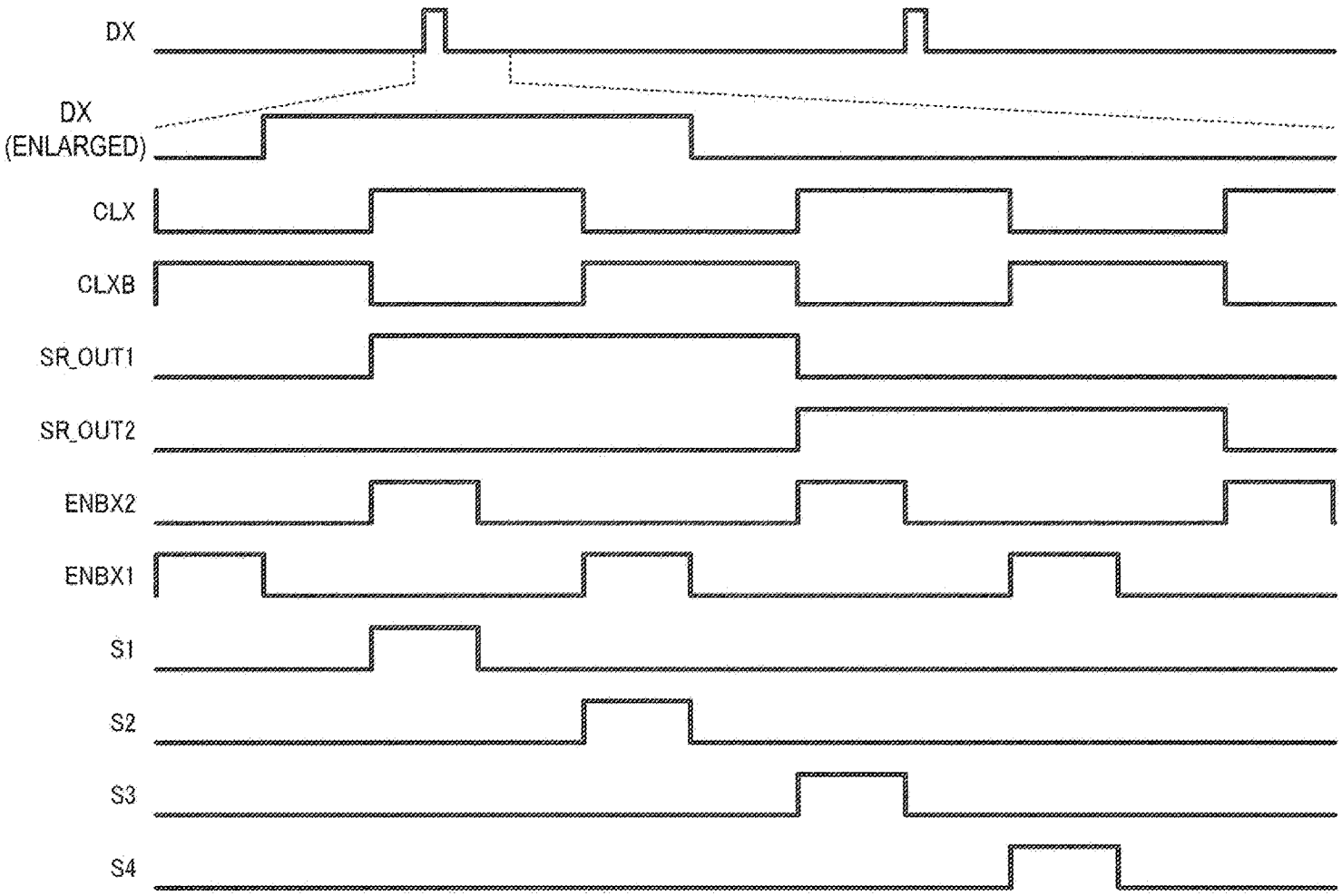
FIG. 9 is a timing chart illustrating an operation of the electro-optical panel.

As illustrated in FIG. 9, the shift register 211 outputs pulse signals SR_OUT1, SR_OUT2, . . . by sequentially shifting the transfer initiation pulse DX supplied at the beginning of the horizontal scanning period in accordance with a clock signal CLX and a reverse signal CLXB of the clock signal. Here, a configuration is illustrated in which one pulse signal SR_OUTj is used for two adjacent data line blocks B(2j−1) and B(2j). When the number of data line blocks is n, the shift register 211 outputs SR_OUT1 to SR_OUT(n/2) as the pulse signals. That is, j is an integer of from 1 to n/2. In other words, FIG. 7 is a drive unit for driving B1 and B2 of the first to n-th data line blocks B1 to Bn, and the data line driving circuit 210 includes n/2 of the drive units arranged side-by-side along a scanning line direction. For example, a second drive unit drives data line blocks B3 and B4 based on a pulse signal SR_OUT2. The same applies to third and subsequent drive units.

The enabling circuit 212 is a circuit for determining whether or not to sample the image signal in accordance with the pulse signal SR_OUTj, and has 2n AND circuits 213 and 2n OR circuits 214. One input end of each of the AND circuits 213 is coupled to an output end of the shift register 211. Thus, the four AND circuits 213 illustrated in FIG. 7 are supplied with the pulse signal SR_OUT1, and the four AND circuits 213 included in the next drive unit are supplied with SR_OUT2. The same applies to SR_OUT3. Further, enable signals ENBX1-1, ENBX1-2, ENXB2-1, ENBX2-2 are supplied to the other input ends of the four AND circuits 213 to which the given pulse signal SR_OUTj is supplied.

A logical product of any of the enable signals of ENBX1-1, ENBX1-2, ENXB2-1, ENBX2-2, and the pulse signal SR_OUTj output from the shift register 211 is computed by each AND circuit 213. The outputs of the AND circuits 213 are coupled to one ends of the OR circuits 214. The other ends of the OR circuits 214 are supplied with NRG, which is a control signal for pre-charging. Note that, here, a period other than the pre-charge period is taken into consideration, therefore NRG is at a low level, and the outputs of the OR circuits 214 correspond to the outputs of the and circuits 213. That is, the logical product of the enable signal and the pulse signal SR_OUTj is output from each OR circuit 214 of the enabling circuit 212.

Here, the enable signals, ENBX1-1, ENBX1-2, ENBX2-1, ENBX2-2, have pulses at timings corresponding to each of the pulse signals SR_OUT1, SR_OUT2, . . . , as illustrated in FIG. 9. Note that ENBX1 in FIG. 9 represents ENBX1-1 and ENBX1-2. Similarly, ENBX2 in FIG. 9 represents ENBX2-1 and ENBX2-2. Although phase differences may occur between ENBX1-1 and ENBX1-2, and between ENBX2-1 and ENBX2-2, such phase differences will be described later in the third exemplary embodiment, and descriptions thereof are omitted in the present exemplary embodiment.

As illustrated in FIG. 9, the pulse widths of ENBX1-1 and ENBX2-1 are encompassed by the period of the pulse width from the front edge to the back edge of the pulse signal SR_OUTj, and further, the pulse widths of ENBX1-1 and ENBX2-1 do not overlap in time. Similarly, the pulse widths of ENBX1-2 and ENBX2-2 are encompassed by the period of the pulse width from the front edge to the back edge of the pulse signal SR_OUTj, and the pulse widths of ENBX1-2 and ENBX2-2 do not overlap in time.

The phase selection signals S1 to Sn, which are the outputs of the enabling circuit 212, are generated as logical products of the pulse signal SR_OUTj and any one of ENBX1-1, ENBX1-2, ENXB2-1, ENBX2-2 having the same waveform as S1 to Sn. As a result, as illustrated in FIGS. 9, the periods in which the phase selection signals S1, S2, . . . , Sn are at the active level does not overlap in time. Note that S1 in FIG. 9 represents S1-2 that is a logical product of ENBX2-2 and SR_OUT1, and S1-1 that is a logical product of ENBX2-1 and SR_OUT1. S2 in FIG. 9 represents S2-2 that is a logical product of ENBX1-2 and SR_OUT1, and S2-1 that is a logical product of ENBX1-1 and SR_OUT1. The same applies to S3 and subsequent signals, and each phase selection signal includes a signal corresponding to the first circuit device 110 and a signal corresponding to the second circuit device 120.

An i-th switch circuit 216-*i* of the first to n-th switch circuits 216-1 to 216-*n* is a circuit that samples VID1 to VID64 supplied via the 64 image signal lines 215 based on a phase selection signal Si, and supplies the sampling result to each data line 230. The i-th switch circuit 216-*i* has a switch for each data line 230. Each switch is, for example, a transistor whose drain is coupled to the data line 230 and whose source is coupled to any one of the image signal lines 215. The phase selection signal Si is supplied to the gate of the transistor, which is a switch.

For example, during a given horizontal scanning period, the shift register 211 of the data line driving circuit 210 sequentially output the pulse signals SR_OUT1 to SR_OUT (n/2) corresponding to the n data line blocks B1 to Bn.

For example, during the first half of the period in which the SR_OUT1 is at the active level, ENBX2-1 is at the active level. The phase selection signal S1-1, which is the output of the enabling circuit 212, is at the active level, therefore 32 switches corresponding to the odd-numbered data lines 230 of the first data line block B1 are turned on. At this time, VID1, VID3, . . . , VID63 supplied to the image signal lines 215 are sampled to the corresponding data lines 230, respectively, and thus supplied to the pixel electrodes.

Similarly, during the first half of the period in which the SR_OUT1 is at the active level, ENBX2-2 is at the active level. The phase selection signal S1-2, which is the output of the enabling circuit 212, is at the active level, therefore 32 switches corresponding to the even-numbered data lines 230 of the first data line block B1 are turned on. At this time, VID2, VID4, . . . , VID64 supplied to the image signal lines 215 are sampled to the corresponding data lines 230, respectively, and thus supplied to the pixel electrodes.

In addition, during the latter half of the period in which the SR_OUT1 is at the active level, ENBX1-1 is at the active level. The phase selection signal S2-1, which is the output of the enabling circuit 212, is at the active level, therefore 32 switches corresponding to the odd-numbered data lines 230 of the second data line block B2 are turned on. At this time, VID1, VID3, . . . , VID63 supplied to the image signal lines 215 are sampled to the corresponding data lines 230, respectively, and thus supplied to the pixel electrodes.

Similarly, during the latter half of the period in which the SR_OUT1 is at the active level, ENBX1-2 is at the active level. The phase selection signal S2-2, which is the output of the enabling circuit 212, is at the active level, therefore 32 switches corresponding to the even-numbered data lines 230 of the second data line block B2 are turned on. At this time, VID2, VID4, . . . , VID64 supplied to the image signal lines 215 are sampled to the corresponding data lines 230, respectively, and thus supplied to the pixel electrodes.

The same applies to subsequent signals. During one horizontal scanning period, sampling of the image signals is performed sequentially for the data line blocks B1 to Bn, and as a result, voltages corresponding to the image signals are applied to the total pixel electrodes in the q columns.

Figure 8:
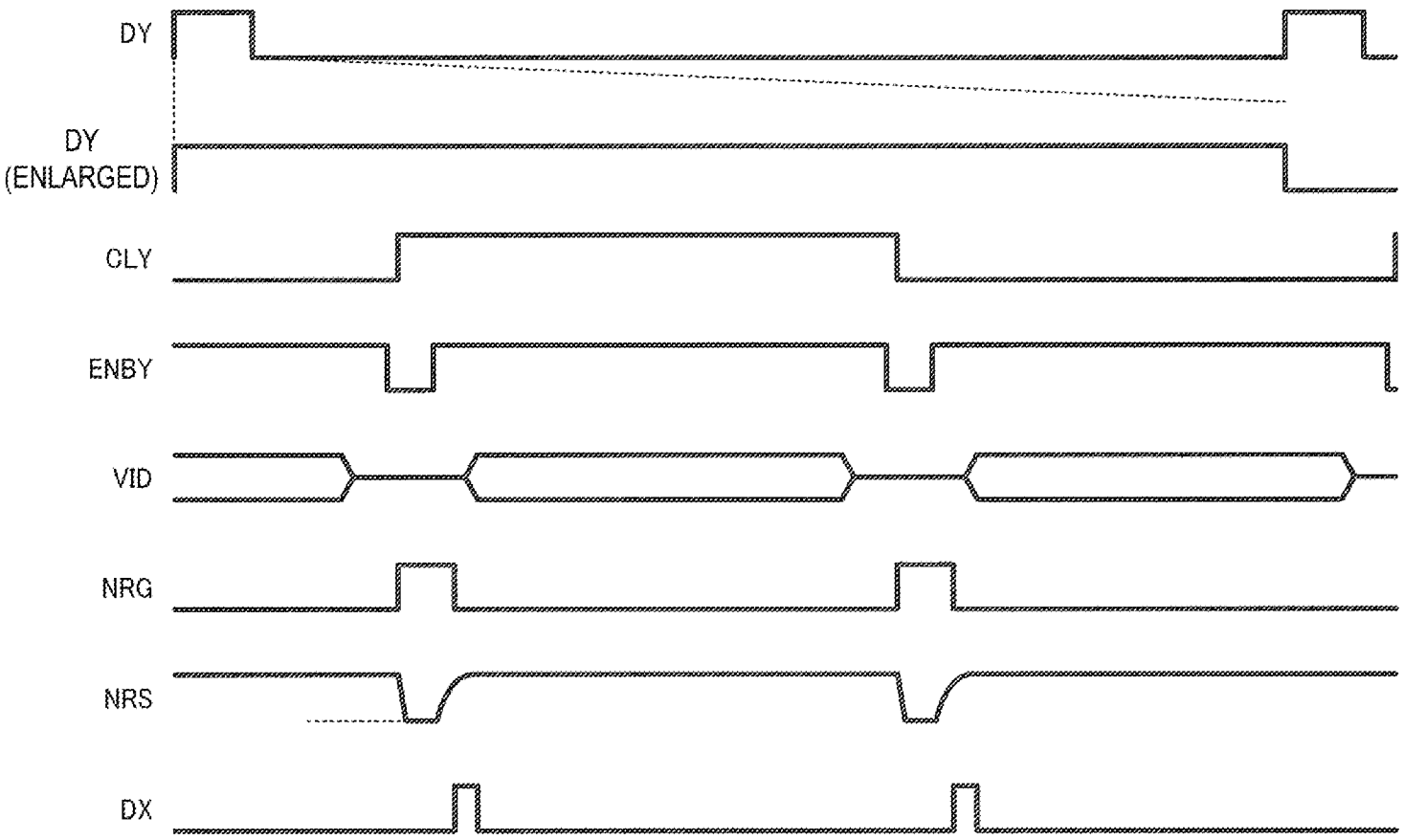
FIG. 8 is a timing chart illustrating an operation of the electro-optical panel.

FIG. 8 is a timing chart illustrating operation of the electro-optical panel 200 of the present exemplary embodiment. As described above, DY is the start transfer pulse supplied at the beginning of the vertical scan period, and CLY is the clock signal corresponding to the single horizontal scanning period. ENBY is the enable signal. During the period when ENBY is at the active level, VID is supplied to the data lines 230, where VID corresponds to a data signal for a single row. NRG is a pulse signal representative of the pre-charge period. NRS is a signal used for the pre-charging. During the period when the NRG is at the active level, the pre-charging is performed by NRS being supplied to the data line 230. DX is the start transfer pulse that is supplied at the beginning of the horizontal scan period.

FIG. 9 is a timing chart illustrating a detailed operation of the electro-optical panel 200 during the horizontal scanning period. CLX is the clock signal used for driving in data line block units. CLXB is an inverted signal of CLX. As described above, the shift register 211 output the pulse signals SR_OUT1 to SR_OUT(n/2) by shifting DX based on CLX and CLXB.

As described above, ENBX2 in FIG. 9 represents ENBX2-1 and ENBX2-2. ENBX1 in FIG. 9 represents ENBX1-1 and ENBX1-2. The phase difference of the enable signal will be described later.

The phase selection signal S1 represents a phase selection signal S1-1 that is a logical product of SR_OUT1 and ENBX2-1, and a phase selection signal S1-2 that is a logical product of SR_OUT1 and ENBX2-2. The phase selection signal S2 represents a phase selection signal S2-1 that is a logical product of SR_OUT1 and ENBX1-1, and a phase selection signal S2-2 that is a logical product of SR_OUT1 and ENBX1-2. The phase selection signal S3 and the phase selection signal S4 are signals based on SR_OUT2 and ENBX1-1, ENBX1-2, ENXB2-1, ENBX2-2. The same applies to subsequent signals.

As described above, the electro-optical device 10 of the present exemplary embodiment includes the electro-optical panel 200 having the first to n-th data line blocks B1 to Bn, the first circuit device 110 that drives the electro-optical panel 200, and the second circuit device 120 that drives the electro-optical panel 200. As illustrated in FIG. 6, the first to n-th data line blocks B1 to Bn are, along the scanning line direction of the electro-optical panel 200, arranged side-by-side so that an i+1-th data line block Bi+1 is located next to an i-th data line block Bi. n is an integer of 2 or greater, and i is an integer satisfying $1 \leq i < n$. The scanning line direction is a direction in which the scanning lines 240 extend, and is a direction along the X axis in FIG. 6.

Here, each data line block includes a first data line group and a second data line group. The first circuit device 110 drives, in the i-th phase of the phase development drive, the first data line group of the i-th data line block Bi of the first to n-th data line blocks B1 to Bn. The second circuit device 120 drives, in the i-th phase of the phase development drive, the second data line group of the i-th data line block Bi of the first to n-th data line blocks B1 to Bn. That is, the first data line group is a collection of the data lines 230 driven by the first circuit device 110, and corresponds to the data lines to which the image signals after phase development output from the first circuit device 110 are supplied. In the present exemplary embodiment, the first data line group corresponds to the data lines to which VID1, VID3, . . . , VID63 are supplied. The second data line group is a collection of the data lines 230 driven by the second circuit device 120, and corresponds to the data lines to which the image signals after phase development output from the second circuit device 120 are supplied. In the present exemplary embodiment, the second data line group corresponds the data lines to which VID2, VID4, . . . , VID64 are provided. Note that, as described above, the number of the circuit devices provided at the electro-optical device 10 according to the present exemplary embodiment may be three or more. For example, when a third circuit device is provided, each data line block includes a third data line group driven by the third circuit device in addition to the first data line group and the second data line group.

According to the approach of the present exemplary embodiment, in a configuration in which the plurality of circuit devices for the phase development are used to drive one electro-optical panel 200, the first data line group of one data line block is driven by the first circuit device 110, and the second data line group is driven by the second circuit device 120. The first to n-th data line blocks B1 to Bn are arranged in this order along the +X direction in FIG. 6, for example. In other words, when considering the entire pixel area of the electro-optical panel 200, the first data line group is distributed in a plurality of areas that are not continuous. Similarly, the second data line group is distributed in a plurality of areas that are not continuous.

An image signal that is the output of the first circuit device 110 and an image signal that is the output of the second circuit device 120 have variations per circuit device, so that the output voltages thereof are slightly different. Thus, for example, in a case where the first circuit device 110 drives q/2 data lines 230 in the −X direction and the second circuit device 120 drives q/2 data lines 230 in the +X direction, a gradation difference caused by a difference in the output voltages between the circuit devices may be visually recognized, and the display quality may deteriorate. In that regard, by the first data line group and the second data line group being arranged in a distributed manner, variations in the data signals are less likely to be visually recognized, which improves the display quality.

More specifically, as described above using FIGS. 5 to 7, the data lines 230 of the first data line group and the data lines 230 of the second data line group of each data line block are arranged adjacent to each other. For example, the first data line group in the present exemplary embodiment is a collection of the odd-numbered data lines 230 of each data line block. The second data line group is a collection of the even-numbered data lines 230 of each data line block. In other words, the data lines 230 of the first data line group and the data lines 230 of the second data line group are alternately arranged.

In this manner, the degree of dispersion of the first data line group driven by the first circuit device 110 and the second data line group driven by the second circuit device 120 is increased, which allows the variations of the data signals to be less visible.

As also illustrated in FIG. 7, the electro-optical panel 200 includes the first to n-th switch circuits 216-1 to **216-*n*. The i-th switch circuit 216-*i* of the first to n-th switch circuits 216-1 to 216-*n* outputs, in the i-th phase of the phase development drive, the first data signal group of the first circuit device 110 to the first data line group of the i-th data line block by selecting the i-th data line block Bi. Further, the i-th switch circuit 216-*i* outputs, in the i-th phase of the phase development drive, the second data signal group of the second circuit device 120 to the second data line group of the i-th data line block Bi by selecting the i-th data line block Bi. For example, the enabling circuit 212 illustrated in FIG. 7** outputs, based on the pulse signal SR_OUT1, the phase selection signal S1 corresponding to the first phase of the phase development drive, and the phase selection signal S2 corresponding to the second phase. In the first phase of the phase development drive, the first switch circuit 216-1 illustrated in FIG. 7 selects, based on the phase selection signal S1, the first data line block B1. In the second phase of the phase development drive, the second switch circuit 216-2 selects, based on the phase selection signal S2, the second data line block B2. The same applies to a third phase and subsequent phases of the phase development drive.

Here, the first data signal group corresponds to VID1-1 to VID32-1 output by the first circuit device 110, and corresponds to VID1, VID3, . . . , VID63, for example, as illustrated in FIG. 5. The second data signal group corresponds to VID1-2 to VID32-2 output by the second circuit device 120, and corresponds to VID2, VID4, . . . , VID64, for example, as illustrated in FIG. 5.

According to the approach of the present exemplary embodiment, by sequentially controlling the on/off of the first to n-th switch circuits 216-1 to **216-*n*, the first data signal group and the second data signal group can be output to appropriate data lines 230** at appropriate timings.

2. Second Exemplary Embodiment

In the first exemplary embodiment, an example has been described in which the data lines 230 driven by the first circuit device 110 and the data lines 230 driven by the second circuit device 120 are alternately arranged. However, the arrangement of the first data line group and the second data line group is not limited thereto. Note that, detailed descriptions for the features identical to those of the first exemplary embodiment are omitted.

Figure 10:
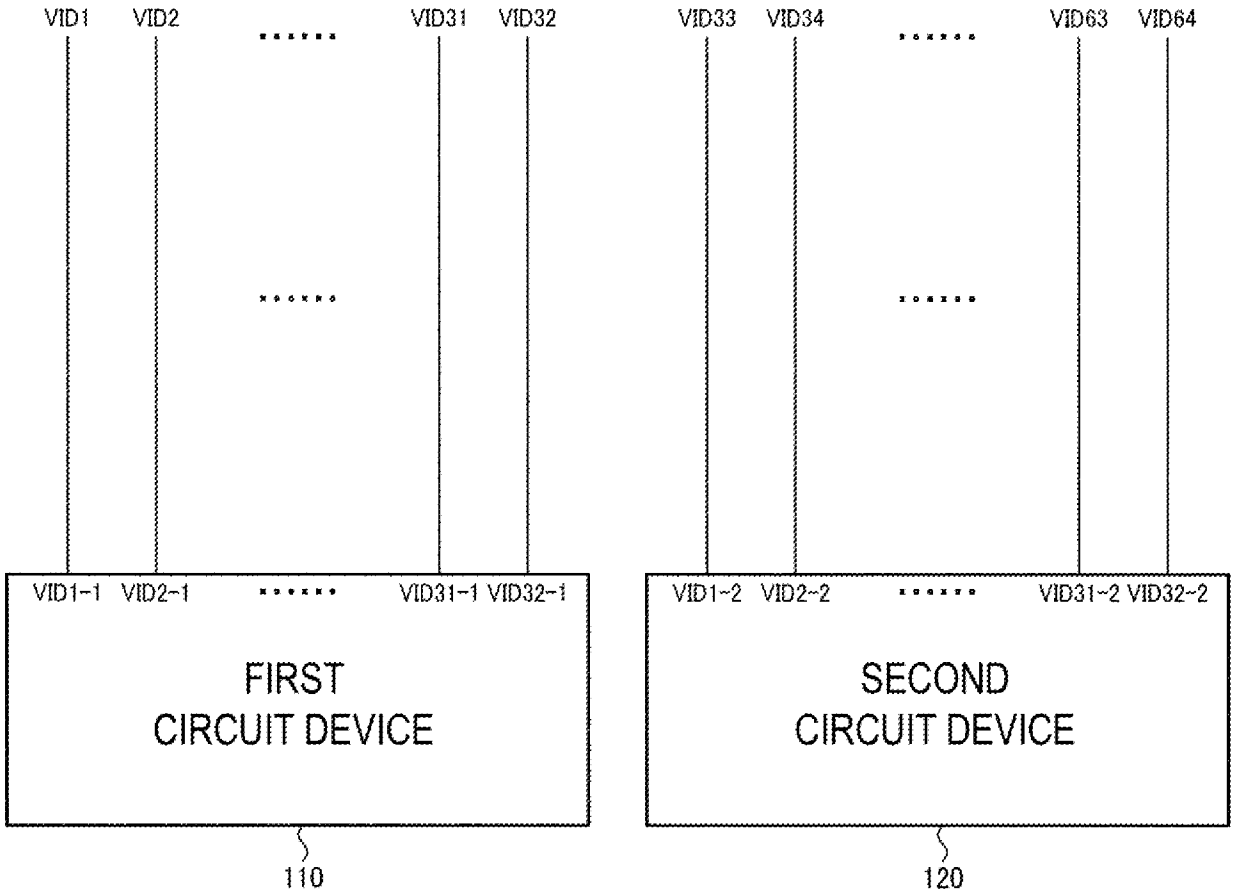
FIG. 10 is another diagram illustrating a correspondence relationship between phase-deployed image signals.

FIG. 10 is another diagram illustrating a relationship between the image signals output by the first circuit device 110 and the second circuit device 120 and the image signals input to the electro-optical panel 200. The feature where the image signals VID1 to VID64 of the 64 systems are input into the electro-optical panel 200 is the same as in the first exemplary embodiment. The same applies to the feature where the first circuit device 110 and the second circuit device 120 output the image signals of the 32 systems, VID1-1 to VID32-1, and VID1-2 to VID32-2, respectively.

As illustrated in FIG. 10, in an approach of the present exemplary embodiment, VID1-1 to VID32-1 of the first circuit device 110 correspond to VID1 to VID32, respectively. VID1-2 to VID32-2 of the second circuit device 120 correspond to VID33 to VID64, respectively. In other words, the first circuit device 110 drives, among respective data line blocks, the 32 data lines 230 in a first direction along the X axis. The second circuit device 120 drives, among respective data line blocks, the 32 data lines 230 in a second direction that is an opposite direction of the first direction. The first direction may be the −X direction or the +X direction.

Figure 11:
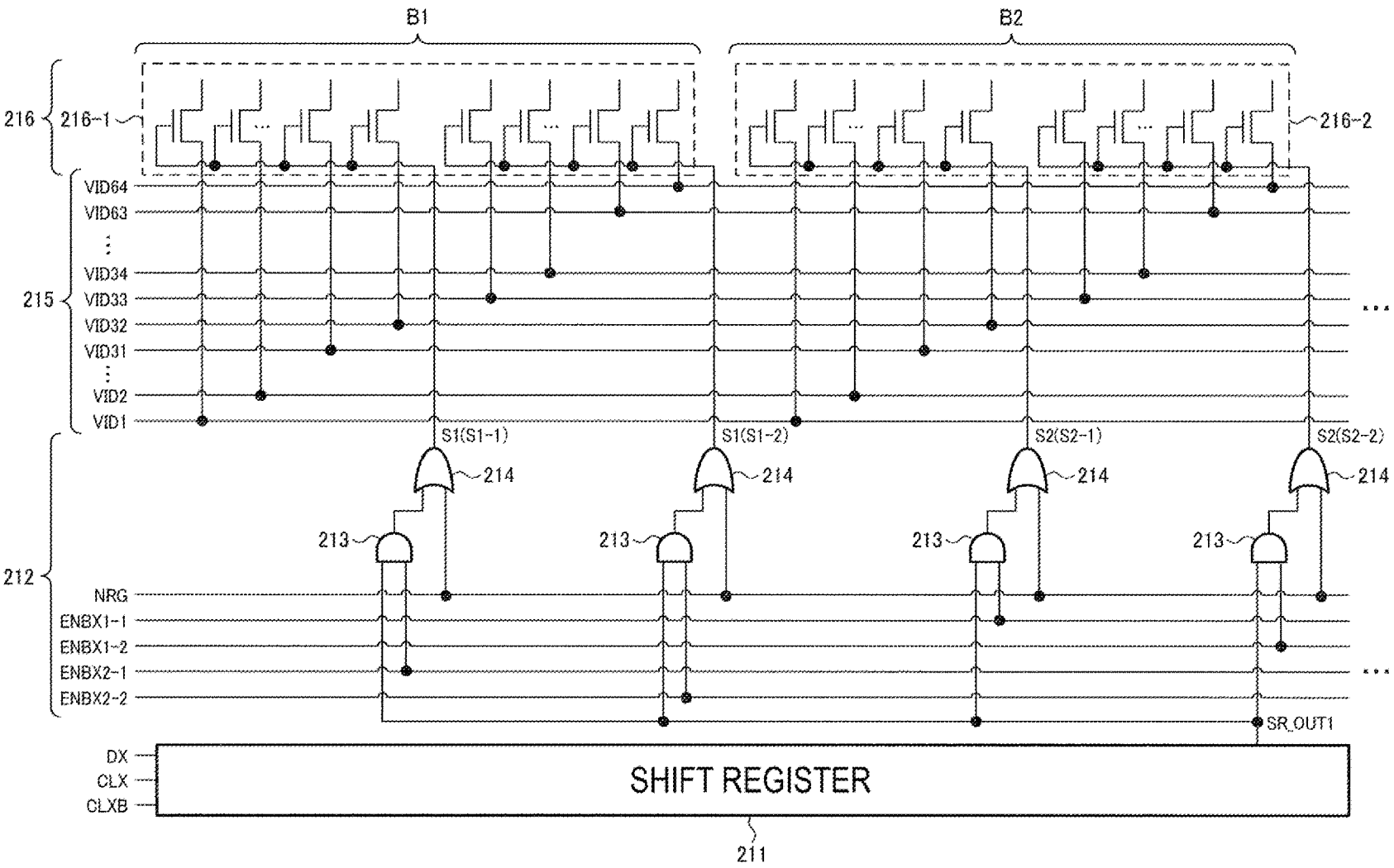
FIG. 11 is another configuration example of the data line driving circuit.

FIG. 11 is a diagram illustrating a configuration of the data line drive circuit 210 of the second exemplary embodiment. The data line driving circuit 210 includes the shift register 211, an enabling circuit 212, image signal lines 215, and a switch circuit 216.

The shift register 211 and enabling circuit 212 are similar to the first exemplary embodiment. The shift register 211 outputs the pulse signals SR_OUT1 to SR_OUT(n/2). The enabling circuit 212 outputs phase selection signals based on the pulse signal SR_OUTj and ENBX1-1, ENBX1-2, ENXB2-1, ENBX2-2.

The i-th switch circuit **216-*i* of the first to n-th switch circuits 216-1 to 216-*n* samples VID1 to VID64 supplied via the 64 image signal lines 215 based on the phase selection signal Si, and supplies the sampling result to each data line 230. The i-th switch circuit 216-*i* has a switch for each data line 230**.

In the second exemplary embodiment, as illustrated in FIG. 11, sources of the transistors to which the phase selection signal S1-1 based on ENBX2-1 is supplied are coupled to the image signal lines 215 corresponding to VID1 to VID32. Sources of the transistors to which the phase selection signal S1-2 based on ENBX2-2 is supplied are coupled to the image signal lines 215 corresponding to VID33 to VID64.

Similarly, sources of the transistors to which the phase selection signal S2-1 based on ENBX1-1 is supplied are coupled to the image signal lines 215 corresponding to VID1 to VID32. Sources of the transistors to which the phase selection signal S2-2 based on ENBX1-2 is supplied are coupled to the image signal lines 215 corresponding to VID33 to VID64.

For example, during the first half of the period in which the SR_OUT1 is at the active level, ENBX2-1 is at the active level. The phase selection signal S1-1, which is the output of the enabling circuit 212, is at the active level, therefore 32 switches corresponding to the first to 32-th data lines 230 of the first data line block B1 are turned on. At this time, VID1 to VID32 supplied to the image signal lines 215 are sampled to the corresponding data lines 230, respectively, and thus supplied to the pixel electrodes.

Similarly, during the first half of the period in which the SR_OUT1 is at the active level, ENBX2-2 is at the active level. The phase selection signal S1-2, which is the output of the enabling circuit 212, is at the active level, therefore 32 switches corresponding to the 33-th to 64-th data lines 230 of the first data line block B1 are turned on. At this time, VID33 to VID64 supplied to the image signal lines 215 are sampled to the corresponding data lines 230, respectively, and thus supplied to the pixel electrodes.

In addition, during the latter half of the period in which the SR_OUT1 is at the active level, ENBX1-1 is at the active level. The phase selection signal S2-1, which is the output of the enabling circuit 212, is at the active level, therefore 32 switches corresponding to the first to 32-th data lines 230 of the second data line block B2 are turned on. At this time, VID1 to VID32 supplied to the image signal lines 215 are sampled to the corresponding data lines 230, respectively, and thus supplied to the pixel electrodes.

Similarly, during the latter half of the period in which the SR_OUT1 is at the active level, ENBX1-2 is at the active level. The phase selection signal S2-2, which is the output of the enabling circuit 212, is at the active level, therefore 32 switches corresponding to the 33-th to 64-th data lines 230 of the second data line block B2 are turned on. At this time, VID33 to VID64 supplied to the image signal lines 215 are sampled to the corresponding data lines 230, respectively, and thus supplied to the pixel electrodes.

The same applies to subsequent signals. During one horizontal scanning period, sampling of the image signals is performed sequentially for the data line blocks B1 to Bn, and as a result, voltages corresponding to the image signals are applied to the total pixel electrodes in the q columns.

Note that in the second exemplary embodiment, the first video input interface 114 of the first circuit device 110 acquires data in which digital image data corresponding to every 32 data lines 230 (for example, the first to 32-th, 65-th to 96-th, etc.) of the electro-optical panel 200 is arranged in a time series manner. The second video input interface 124 of the second circuit device 120 acquires data in which digital image data corresponding to every 32 data lines 230 (for example, 33-th to 64-th, 97-th to 128-th, etc.) of the electro-optical panel 200 is arranged in a time series manner.

According to the approach of the present exemplary embodiment, in the data line blocks of the first to n-th data line blocks B1 to Bn, the first data line group and the second data line group are arranged adjacent to each other. For example, when one data line block includes 64 data lines 230, the first data line group is a collection of the 32 consecutive data lines 230 and the second data line group is a collection of the 32 consecutive data lines 230.

When comparing the first exemplary embodiment with the second exemplary embodiment, the first exemplary embodiment has a high degree of dispersion of the data line groups, which is advantageous in that the variations in the output voltage between the circuit devices are less likely to be visually recognized. In addition, in the second exemplary embodiment, the first data line group and the second data line group are arranged in a distributed manner throughout the electro-optical panel 200, but a plurality of the data lines 230 are arranged collectively, which is advantageous from the perspective of ease of wiring.

Note that in the first exemplary embodiment and the second exemplary embodiment, examples has been described in which the data lines 230 of the first data line group and the data lines 230 of the second data line group are arranged every one line or every 32 lines. However, the approach of the present disclosure is not limited thereto, and variations are possible in which the data lines 230 of each data line group are arranged every different number, such as every four lines, every eight lines, etc.

3. Third Exemplary Embodiment

Next, a configuration including a timing adjustment circuit 130 will be described as a third exemplary embodiment. Note that an approach of the third exemplary embodiment may be combined with the configuration of any of the first and second exemplary embodiments. Especially, the variations between the circuit devices are relatively conspicuous in the second exemplary embodiment, so that it is of great significance to combine the second exemplary embodiment with the present exemplary embodiment.

The variations in the output voltages have been described above as variations between the first circuit device 110 and the second circuit device 120. However, the variations are not limited thereto, and the timing of control signals and image signals also varies depending on the circuit device.

Figure 12:
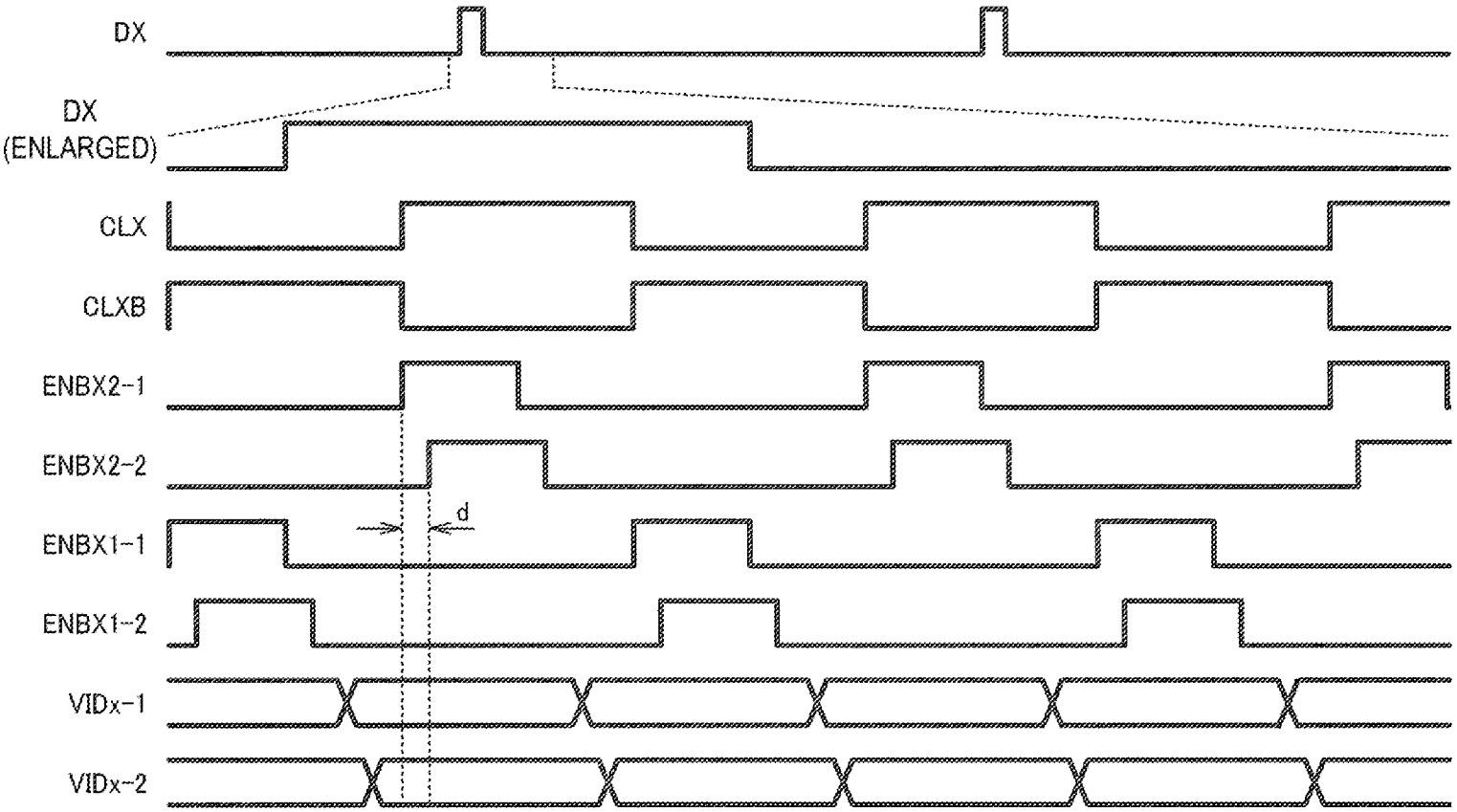
FIG. 12 is a timing chart illustrating an operation of the electro-optical panel.

FIG. 12 is a timing chart illustrating an operation of the electro-optical panel 200. In FIG. 12, VIDx-1 corresponds to VID1-1 to VID32-1 output by the first circuit device 110, and VIDx-2 corresponds to VID1-2 to VID32-2 output by the second circuit device 120. As illustrated in FIG. 12, there is a difference between a timing at which the first circuit device 110 outputs VIDx-1 and a timing at which the second circuit device 120 outputs VIDx-2. Hereinafter, this difference is designated as a phase difference d.

At this time, in a case where both VIDx-1 and VIDx-2 are sampled using ENBX1-1 and ENBX2-1 that are the enable signals output by the first circuit device 110, the display quality may deteriorate due to the phase difference d. This is because the period for which ENBX1-1 or ENBX2-1 is at the active level and the period in which VIDx-2 is output does not correspond to each other properly, and the desired output voltages may not be applied to the pixel electrodes.

As described above using FIG. 4, a configuration is conceivable in which the first circuit device 110 outputs ENBX1-1 and ENBX2-1 to the electro-optical panel 200, and the second circuit device 120 outputs ENBX1-2 and ENBX2-2 to the electro-optical panel 200. All of ENBX1-1, ENBX2-1, and VIDx-1 are signals generated based on the internal synchronization signal of the first circuit device 110, so that ENBX1-1 and ENBX2-1 are expected to be signals with timing suitable for the output of VIDx-1. Similarly, ENBX1-2 and ENBX2-2 are expected to be signals with timing suitable for the output of VIDx-2. Therefore, the configuration described above using FIG. 4 also appears to allow appropriate driving. However, the path in which the image signal is input to the electro-optical panel 200 may be different from the path in which the control signal is input to the electro-optical panel 200.

Figure 13:
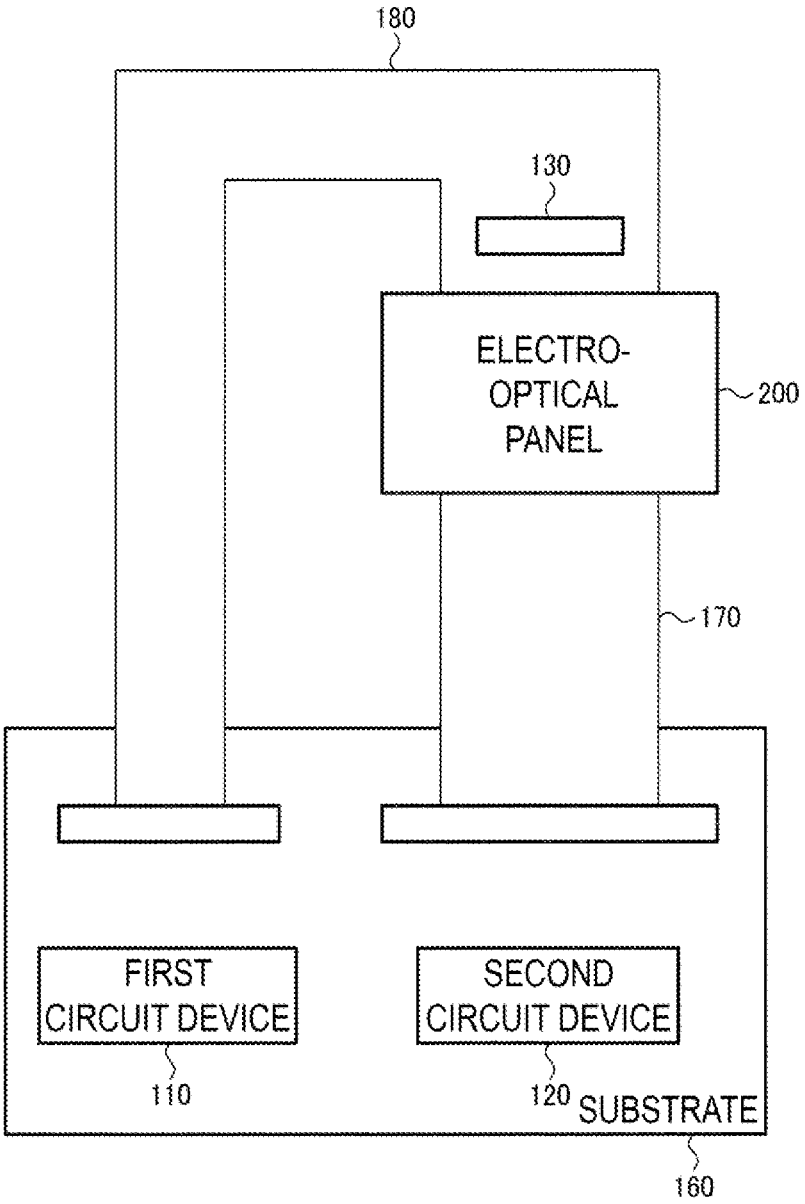
FIG. 13 is an example of coupling of the first circuit device and the second circuit device, and the electro-optical panel.

FIG. 13 is a diagram illustrating coupling of a substrate 160 and the electro-optical panel 200. The first circuit device 110 and the second circuit device 120 are provided at the substrate 160. As illustrated in FIG. 13, the electro-optical device 10 includes a first flexible substrate 170 and a second flexible substrate 180. The substrate 160 is coupled to a given one side of the electro-optical panel 200 by the first flexible substrate 170. Furthermore, the substrate 160 is coupled to another side facing the given one side by the second flexible substrate 180. The image signal output from the first circuit device 110 and the second circuit device 120 is input to the electro-optical panel 200 via the first flexible substrate 170. The control signal output from the first circuit device 110 and the second circuit device 120 is input to the electro-optical panel 200 via the second flexible substrate 180.

In the configuration illustrated in FIG. 13, the path of the control signal to the electro-optical panel 200 is different from the path of the image signal to the electro-optical panel 200, therefore, there is a possibility that the timing of the control signal and the image signal may be shifted. Accordingly, the electro-optical device 10 of the present exemplary embodiment may include the timing adjustment circuit 130 as illustrated in FIG. 13. The timing adjustment circuit 130 is provided, for example, at the second flexible substrate 180.

Figure 14:
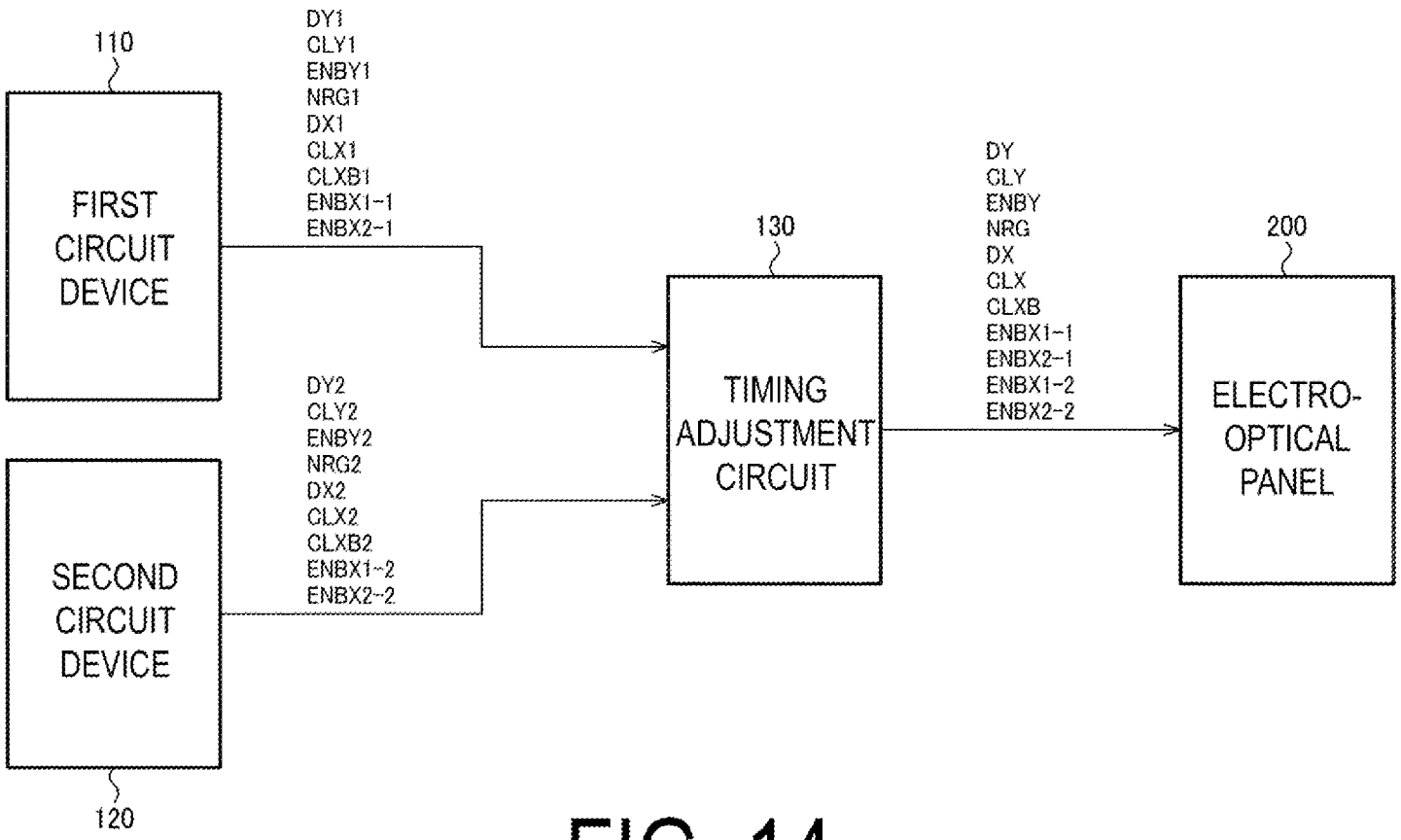
FIG. 14 is an example of control signals output by the first circuit device, the second circuit device, and the timing adjustment circuit.

FIG. 14 is a diagram illustrating a relationship between the control signal output by the first circuit device 110 and the second circuit device 120 and the control signal output by the timing adjustment circuit 130. As described above using FIGS. 2 and 3, the first circuit device 110 is capable of outputting DY1, CLY1, ENBY1, NRG1, DX1, CLX1, CLXB1, ENBX1-1, ENBX2-1. The second circuit device 120 is capable of outputting DY2, CLY2, ENBY2, NRG2, DX2, CLX2, CLXB2, ENBX1-2, ENBX2-2.

Based on these control signals, the timing adjustment circuit 130 outputs DY, CLY, ENBY, NRG, DX, CLX, CLXB, as well as the enable signals ENBX1-1, ENBX2-1, ENBX1-2, ENBX2-2.

Figure 15:
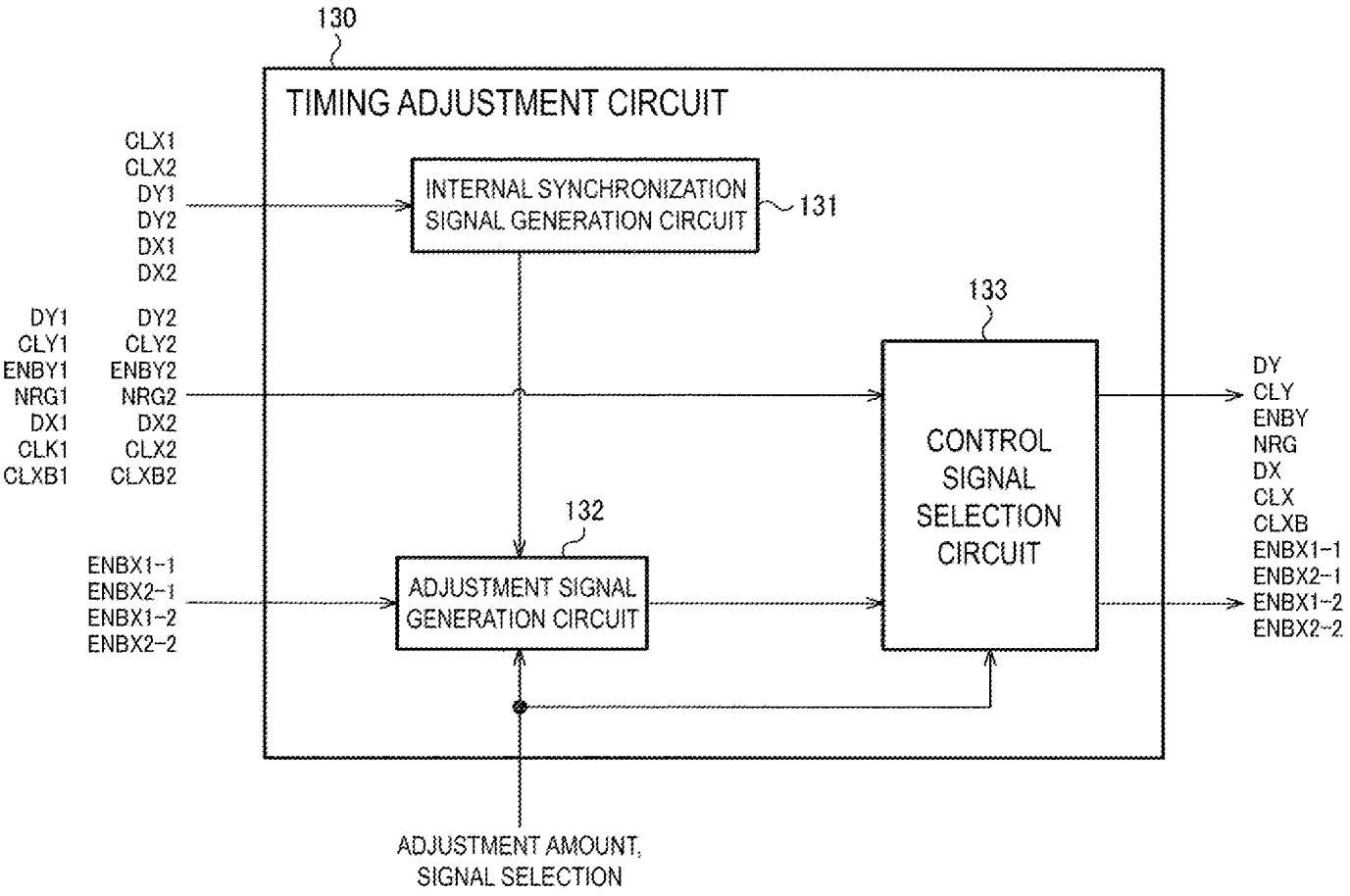
FIG. 15 is a configuration example of a timing adjustment circuit.

FIG. 15 is a diagram illustrating a configuration of the timing adjustment circuit 130. The timing adjustment circuit 130 includes an internal synchronization signal generation circuit 131, an adjustment signal generation circuit 132, and a control signal selection circuit 133.

The internal synchronization signal generation circuit 131 generates an internal synchronization signal used within the timing adjustment circuit 130 based on any one of CLX1, DY1, DX1, and CLY2, DY2, DX2. The internal synchronization signal includes, for example, a dot clock signal, a horizontal synchronization signal, a vertical synchronization signal, etc. The internal synchronization signal is output to the adjustment signal generation circuit 132.

The adjustment signal generation circuit 132 adjusts the timing of ENBX1-1 and ENBX2-1 from the first circuit device 110 and ENBX1-2 and ENBX2-2 from the second circuit device 120. For example, the adjustment signal generation circuit 132 includes a delay circuit and generates a delay signal ENBX1-1delay by delaying ENBX1-1 by a delay amount set based on the dot clock signal. Similarly, the adjustment signal generation circuit 132 generates delay signals ENBX2-1delay, ENBX1-2delay, ENBX2-2delay based on each of ENBX2-1, ENBX1-2, ENBX2-2.

The control signal selection circuit 133 performs processing of selecting any control signal from a plurality of the control signals. For example, the control signal selection circuit 133 selects any one of (DY1, CLY1, ENBY1, NRG1, DX1, CLX1, CLXB1) from the first circuit device 110 and (DY2, CLY2, ENBY2, NRG2, DX2, CLX2, CLXB2) from the second circuit device 120. The control signal selection circuit 133 outputs the selected signals to the electro-optical panel 200 as control signals (DY, CLY, ENBY, NRG, DX, CLX, CLXB).

The control signal selection circuit 133 selects any one of ENBX1-1 and the delay signal ENBX1-1delay from the first circuit device 110, and outputs the selected signal to the electro-optical panel 200 as the enabling signal ENBX1-1. The same applies to other enable signals. The control signal selection circuit 133 outputs one of ENBX2-1 and ENBX2-1delay as ENBX2-1, outputs one of ENBX1-2 and ENBX1-2delay as ENBX1-2, and outputs one of ENBX2-2 and ENBX2-2delay as ENBX2-2.

Note that the delay amount in the adjustment signal generation circuit 132, and whether the control signal selection circuit 133 selects any signal, can be changed using register settings, etc., for example. For example, an individual difference between the first circuit device 110 and the second circuit device 120 is measured in advance, and the delay amount and the signal to be selected are set based on the measurement results. However, it is possible to perform variations such as dynamically changing the delay amount based on the comparison process between (CLX1, DY1, DX1) and (CLY2, DY2, DX2).

Further, in the above, an example has been described in which the timing adjustment circuit 130 acquires ENBX1-1 and ENBX2-1 from the first circuit device 110, and ENBX1-2 and ENBX2-2 from the second circuit device 120, and selects and outputs the four enable signals after generating the delay signal from each of them. However, the approach of the present exemplary embodiment is not limited thereto. For example, the timing adjustment circuit 130 may omit acquisition of ENBX1-2 and ENBX2-2 from the second circuit device 120. The timing adjustment circuit 130 may generate and output ENBX1-2 and ENBX2-2 by delaying ENBX1-1 and ENBX2-1. The phase difference d between VIDx-1 and VIDx-2 is known from the register settings, or can be estimated from the comparison of (CLX1, DY1, DX1) and (CLY2, DY2, DX2). Thus, ENBX1-2 and ENBX2-2 can be generated by delaying ENBX1-1 and ENBX2-1 by the delay amount corresponding to the phase difference d.

Additionally, (DY1, CLY1, ENBY1, NRG1, DX1, CLX1, CLXB1), and (DY2, CLY2, ENBY2, NRG2, DX2, CLX2, CLXB2) may be either fixedly selected, but are not limited thereto. For example, the control signal selection circuit 133 may select (DY1, CLY1, ENBY1, NRG1, DX1, CLX1, CLXB1) for a given first period and select (DY2, CLY2, ENBY2, NRG2, DX2, CLX2, CLXB2) for a second time period different from the first period. By rotating the selection of the control signal in time series in this manner, it is possible to further suppress the effects of the individual difference in the circuit devices.

As described above, the electro-optical device 10 of the present exemplary embodiment includes the timing adjustment circuit 130. As illustrated in FIG. 2, the first circuit device 110 includes the first control signal generation circuit 112 that generates and outputs a first control signal group. As illustrated in FIG. 3, the second circuit device 120 includes the second control signal generation circuit 122 that generates and outputs a second control signal group.

The first control signal group includes a first enable signal that determines an on period of the first to n-th switch circuits 216-1 to **216-*n*. The second control signal group includes a second enable signal that determines an on period of the first to n-th switch circuits 216-1 to 216-*n*. The first enable signal is, for example, ENBX1-1 and ENBX2-1. The second enable signal is, for example, ENBX1-2 and ENBX2-2**.

The timing adjustment circuit 130 performs the timing adjustment of the first enable signal and the second enable signal. In this manner, the timing of the first enable signal can be adjusted to VIDx-1, and the timing of the second enable signal can be adjusted to VIDx-2. In other words, even in a case where variations occur in the timing of the image signals in the first circuit device 110 and the second circuit device 120, it is possible to adjust the enable signals in accordance with the variations. Changes in the rising waveform due to the timing difference, etc. can be suppressed, and thus, deterioration in the display quality due to the variations in the circuit device can be suppressed.

The electro-optical panel 200 includes a control circuit that controls the on/off of the first to n-th switch circuits 216-1 to **216-*n*. The control circuit corresponds to the enabling circuit 212 of FIG. 7 or FIG. 10, for example. The control circuit may also include the shift register 211**.

In the i-th phase of the phase development drive, when the first enable signal is active, the control circuit causes the i-th switch circuit **216-*i* to select the first data line group of the i-th data line block Bi. When the second enable signal is active, the control circuit causes the i-th switch circuit 216-*i* to select the second data line group of the i-th data line block Bi. For example, in the first phase of the phase development drive, when ENBX2-1 is active, the first switch circuit 216-1 selects the first data line group of the first data line block B1. Similarly, in the first phase of the phase development drive, when ENBX2-2 is active, the first switch circuit 216-1 selects the second data line group of the first data line block B1**. The same applies to the second phase an subsequent phases.

In this manner, by using the first enable signal ENBX1-1 and ENBX2-1 and the second enable signal ENBX1-2 and ENBX2-2, the appropriate data lines 230 can be selected at the appropriate timing. In particular, in the present exemplary embodiment, the timing adjustment of the first enable signal and the second enable signal is performed, so it is possible to cause the timing at which the data lines 230 selected to correspond to the timing at which the image signals are output.

The timing adjustment circuit 130 may generate a first delay signal by delaying the first enable signal and generate a second delay signal by delaying the second enable signal. The timing adjustment circuit 130 outputs, of the first enable signal and the first delay signal, the selected signal to the electro-optical panel 200. The timing adjustment circuit 130 outputs, of the second enable signal and the second delay signal, the selected signal to the electro-optical panel 200. In this manner, the timing adjustment of the enable signals can be performed using the delay circuit.

The timing adjustment circuit 130 may perform the timing adjustment of the first control signal group and the second control signal group, and output the first control signal group and the second control signal group after the timing adjustment to the electro-optical panel 200. In this manner, the effects of the individual difference in the plurality of circuit devices can be suppressed by the timing adjustment of the control signal. As a result, the display quality of the electro-optical panel 200 can be improved. At this time, one of the first control signal group and the second control signal group may be used as a reference, and the other may be adjusted. Further, both signal groups may be adjusted with each other.

As also illustrated in FIG. 13, the electro-optical device 10 may include the flexible substrate that couples the first circuit device 110 and the second circuit device 120 to the electro-optical panel 200. The timing adjustment circuit 130 is provided, for example, at the flexible substrate. In the example of FIG. 13, the flexible substrate here is the second flexible substrate 180.

In this manner, it is possible to use the flexible substrate for coupling the first circuit device 110 and the second circuit device 120 to the electro-optical panel 200. Further, by providing the timing adjustment circuit 130 at the flexible substrate, the position of the timing adjustment circuit 130 is located closer to the electro-optical panel 200 than to the substrate 160. Since the signal path length of the control signal after the timing adjustment is shortened, the occurrence of error can be suppressed.

4. Electronic Apparatus

Figure 16:
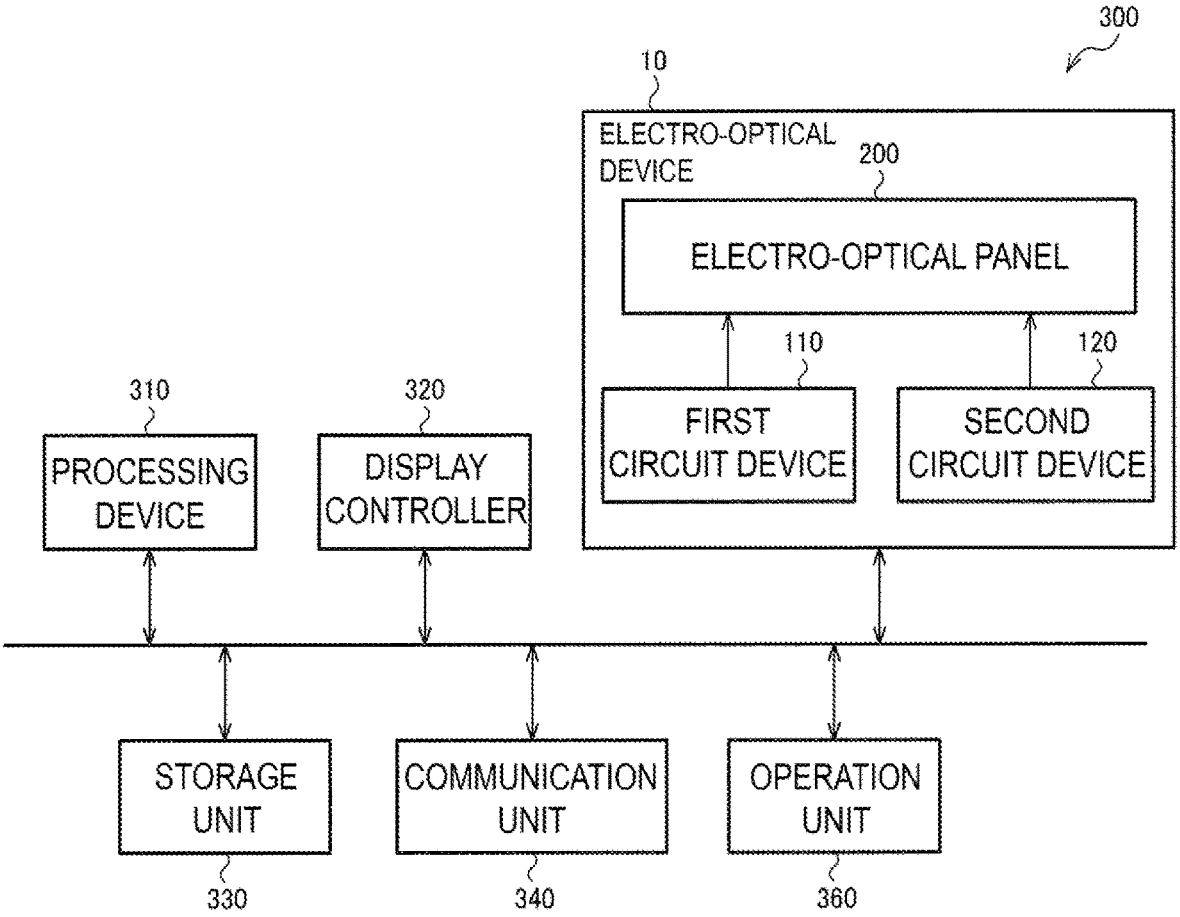
FIG. 16 is a configuration example of an electronic apparatus.

An approach of the present exemplary embodiment can also be applied to the electronic apparatus 300 including the electro-optical device 10 described above. FIG. 16 is a configuration example of the electronic apparatus 300 including the electro-optical device 10. The electronic apparatus 300 includes a processing device 310, a display controller 320, the electro-optical device 10, a storage unit 330, a communication unit 340, and an operation unit 360. The electro-optical device 10 includes the first circuit device 110, the second circuit device 120, and the electro-optical panel 200, as described above.

The storage unit 330 is also called a storage device or memory. The communication unit 340 is also called a communication circuit or a communication device. The operation unit 360 is also called an operation device. Specific examples of the electronic apparatus 300 may include various electronic apparatuses provided with display devices, such as a projector, a head-mounted display, a mobile information terminal, a vehicle-mounted device, a portable game terminal, and an information processing device. The vehicle-mounted device is, for example, a meter panel, a car navigation system, etc.

The operation unit 360 is a user interface for various types of operations by a user. For example, the operation unit 360 is a button, a mouse, a keyboard, and/or a touch panel mounted on the electro-optical panel 200. The communication unit 340 is a data interface used for inputting and outputting image data and control data. Examples of the communication unit 340 include a wireless communication interface, such as a wireless LAN interface or a near field communication interface, and a wired communication interface, such as wired LAN interface or a Universal Social Bus (USB) interface. The storage unit 330, for example, stores data input from the communication unit 340 or functions as a working memory for the processing device 310. The storage unit 330 is, for example, a memory, such as a RAM or a ROM, a magnetic storage device, such as a hard disk drive (HDD), or an optical storage device, such as a CD drive or a DVD drive. The display controller 320 processes image data input from the communication unit 340 or stored in the storage unit 330, and transfers the image data to the electro-optical device 10. The first circuit device 110 and the second circuit device 120 of the electro-optical device 10 cause the electro-optical panel 200 to display an image based on the image data transferred from the display controller 320. The processing device 310 carries out control processing for the electronic apparatus 300 and various types of signal processing. The processing device 310 is, for example, a processor such as a Central Processing Unit (CPU) or an Micro-processing unit (MPU), or an ASIC, etc. In addition, in a case where the electronic apparatus 300 is a projector, the electronic apparatus 300 may further include a light source and an optical system.

Although the present exemplary embodiment has been described in detail above, a person skilled in the art will easily understand that many modified examples can be made without substantially departing from novel items and effects of the present exemplary embodiment. All such modified examples are thus included in the scope of the disclosure. For example, terms in the descriptions or drawings given even once along with different terms having identical or broader meanings can be replaced with those different terms in all parts of the descriptions or drawings. All combinations of the exemplary embodiment and modified examples are also included within the scope of the disclosure. Furthermore, the configurations, operations, etc. of the first circuit device, the second circuit device, the electro-optical device, the electronic apparatus, etc. are not limited to those described in the exemplary embodiment, and various modifications thereof are possible.

What is claimed is:

1. An electro-optical device comprising:

an electro-optical panel including first to n-th data line blocks, each of the data line blocks including a first data line group and a second data line group, n being an integer of 2 or greater;

a first circuit device configured to drive the electro-optical panel; and a second circuit device configured to drive the electro-optical panel, wherein the first to n-th data line blocks are, along a scanning line direction of the electro-optical panel, arranged side-by-side so that an i+1-th data line block is located next to an i-th data line block, i being an integer satisfying $1 \leq i < n$, the first circuit device is configured to, in an i-th phase of phase development drive, drive the first data line group of the i-th data line block of the first to n-th data line blocks, the second circuit device is configured to, in the i-th phase of the phase development drive, drive the second data line group of the i-th data line block of the first to n-th data line blocks, and there is a difference between a timing at which the first circuit device outputs an image signal and a timing at which the second circuit device outputs an image signal.

2. The electro-optical device according to claim 1, wherein a data line of the first data line group and the data line of the second data line group of each of the data line blocks are arranged alternately in the scanning line direction.

3. The electro-optical device according to claim 1, wherein when each of the data line blocks includes m data lines, the first data line group is a collection of m/2 of the data lines arranged consecutively along the scanning line direction, and the second data line group is a collection of m/2 of the data lines arranged consecutively along the scanning line direction, m being an integer of 2 or greater.

4. The electro-optical device according to claim 1, wherein the electro-optical panel includes first to n-th switch circuits, and an i-th switch circuit of the first to n-th switch circuits is configured to, in the i-th phase of the phase development drive, select the i-th data line block, output a first data signal group of the first circuit device to the first data line group of the i-th data line block, and output a second data signal group of the second circuit device to the second data line group of the i-th data line block.

5. The electro-optical device according to claim 4, comprising a timing adjustment circuit, wherein the first circuit device includes a first control signal generation circuit configured to generate and output a first control signal group, the second circuit device includes a second control signal generation circuit configured to generate and output a second control signal group, the first control signal group includes a first enable signal configured to determine an on period of the first to n-th switch circuits, the second control signal group includes a second enable signal configured to determine the on period of the first to n-th switch circuits, and the timing adjustment circuit is configured to perform timing adjustment of the first enable signal and the second enable signal.

6. The electro-optical device according to claim 5, wherein the electro-optical panel includes a control circuit configured to control on/off of the first to n-th switch circuits, and in the i-th phase of the phase development drive, the control circuit is configured to, when the first enable signal is active, cause the i-th switch circuit to select the first data line group of the i-th data line block, and when the second enable signal is active, cause the i-th switch circuit to select the second data line group of the i-th data line block.

7. The electro-optical device according to claim 5, wherein the timing adjustment circuit is configured to generate a first delay signal by delaying the first enable signal, generate a second delay signal by delaying the second enable signal, and output, to the electro-optical panel, any one of the first enable signal or the first delay signal, and any one of the second enable signal or the second delay signal.

8. The electro-optical device according to claim 1, comprising a timing adjustment circuit, wherein the first circuit device includes a first control signal generation circuit configured to generate and output a first control signal group, the second circuit device includes a second control signal generation circuit configured to generate and output a second control signal group, and the timing adjustment circuit is configured to perform timing adjustment of the first control signal group and the second control signal group, and output, to the electro-optical panel, the first control signal group and the second control signal group after the timing adjustment.

9. The electro-optical device according to claim 5, comprising a flexible substrate configured to couple the first circuit device and the second circuit device to the electro-optical panel, wherein the timing adjustment circuit is provided at the flexible substrate.

10. An electronic apparatus comprising:

a processor;

a memory; and an electro-optical device comprising:

an electro-optical panel including first to n-th data line blocks, each of the data line blocks including a first data line group and a second data line group, n being an integer of 2 or greater;

a first circuit device configured to drive the electro-optical panel; and a second circuit device configured to drive the electro-optical panel, wherein the first to n-th data line blocks are, along a scanning line direction of the electro-optical panel, arranged side-by-side so that an i+1-th data line block is located next to an i-th data line block, i being an integer satisfying $1 \leq i < n$, the first circuit device is configured to, in an i-th phase of phase development drive, drive the first data line group of the i-th data line block of the first to n-th data line blocks, the second circuit device is configured to, in the i-th phase of the phase development drive, drive the second data line group of the i-th data line block of the first to n-th data line blocks, and there is a difference between a timing at which the first circuit device outputs an image signal and a timing at which the second circuit device outputs an image signal.

* * * * *